US005994843A

United States Patent [19]

Kataoka et al.

[11] Patent Number: 5,994,843

[45] Date of Patent: Nov. 30, 1999

[54] LIGHT SOURCE LIGHTING DEVICE

[75] Inventors: Shozo Kataoka, Hirakata; Fumio Ueno, Kikuchi-gun; Ikko Harada; Noriaki Hara, both of Kumamoto; Ichirou Oota, Kikuchi-gun, all of Japan

[73] Assignee: Matsushita Electric Works, Ltd., Osaka, Japan

[21] Appl. No.: 08/723,194

[22] Filed: Sep. 27, 1996

[30] Foreign Application Priority Data

Mar. 29, 1996 [JP] Japan ..... 8-077926

[51] Int. Cl.[6] ..... H05B 37/02

[52] U.S. Cl. ..... 315/106; 315/289; 315/307; 315/224; 315/DIG. 7

[58] Field of Search ..... 315/307, DIG. 7, 315/224, 289, 290, 205, 105, 106

[56] References Cited

U.S. PATENT DOCUMENTS

| | | | |
|---|---|---|---|
| 3,657,598 | 4/1972 | Nomura et al. | 315/100 |
| 3,755,686 | 8/1973 | Woods | 307/18 |
| 3,919,590 | 11/1975 | Remery et al. | 315/106 |
| 4,451,743 | 5/1984 | Suzuki et al. | 307/110 |
| 4,897,774 | 1/1990 | Bingham et al. | 363/61 |
| 5,159,244 | 10/1992 | Poulson | 315/205 |
| 5,341,068 | 8/1994 | Nerone | 315/219 |
| 5,397,965 | 3/1995 | Gorille et al. | 315/247 |
| 5,444,310 | 8/1995 | Kataoka et al. | 307/125 |
| 5,481,447 | 1/1996 | Caris et al. | 363/60 |
| 5,519,286 | 5/1996 | Rodrigues et al. | 315/247 |
| 5,710,487 | 1/1998 | Valcke | 315/205 |

FOREIGN PATENT DOCUMENTS

| | | |
|---|---|---|
| 5-174987 | 7/1993 | Japan . |
| 4-337292 | 11/1993 | Japan . |

*Primary Examiner*—Michael B Shingleton
*Attorney, Agent, or Firm*—Lynn & Lynn

[57] ABSTRACT

A light source power supply circuit includes a DC power source and an energy accumulating capacitor connected in parallel through a charging switching element to the DC power source. A polarity inverting circuit is connected across the energy accumulating capacitor for applying the capacitor voltage across a light source with the polarity alternately inverted. A starting high voltage generating circuit applies a high voltage to the light source a high voltage for starting the light source. A control circuit controls a polarity inverting circuit so that the inverting frequency is above a critical fusion frequency for the light source.

9 Claims, 21 Drawing Sheets

LIGHT SOURCE LIGHTING DEVICE

BACKGROUND OF THE INVENTION

This invention relates generally to circuitry for providing power to a gas discharge lamp. This invention relates particularly to circuitry that is small and light in weight for operating a gas discharge lamp to provide a high quality visual environment with stable light intensity.

DESCRIPTION OF THE PRIOR ART

Japanese Patent Laid-Open Publications Nos. 5-174987 and 3-110625 and U.S. Pat. Nos. 5,159,244 and 5,481,447 disclose circuitry for providing power to gas discharge lamps.

Japanese Patent Laid-Open Publications Nos. 5-174987 and disclose highly efficient light source power supply circuits which do not employ large-size components such as choke coils and transformers. These publications disclose circuitry capable of continuously causing a light source to emit light without any flickering at a frequency higher than a critical fusion frequency, while having minimal dimensions and weight.

Japanese Patent Laid-Open Publication No. 5-174987, discloses a capacitor that is connected through a charging switch to a DC power source that has a voltage higher than the lighting voltage of a gas discharge light source. The light source is connected through a discharging switch to the capacitor. The charging and discharging switches are alternately turned ON and OFF to charge and discharge the capacitor. The light source is made to emit light continuously without any flickering at a frequency higher than the critical fusion frequency. The lighting circuit employs a voltage boosting or dropping circuit with a capacitor and switch combined and switches arranged for powering the light source either by a DC voltage or by an AC voltage. Further, a preheating circuit is provided for preheating a discharge lamp such as a fluorescent lamp or the like that requires preheating.

Japanese Patent Laid-Open Publication No. 4-337292, on the other hand, provides an arrangement for lighting the discharge lamp with an AC current by discharging a discharge from a first capacitor to a series circuit of a second capacitor and the discharge lamp to discharged an accumulated charge in the second capacitor.

However, to power the light source with a DC power source without employing any choke coil and transformer, in general, the circuitry must include preheating, starting and polarity inverting circuits and a switch control circuit.

That is, the device must be so arranged that the life of the lamp will not be impaired by any steep pulsating AC source power flowing to the light source. In this case, there has been left a problem unsolved such that, in powering the light source with a DC voltage obtained by rectifying and smoothing a voltage from a commercial AC power source of a controlled value, an overflow of lamp current or the like inconvenience occurs due to the relationship between the voltage upon discharge of the capacitor and the lighting voltage of the light source.

SUMMARY OF THE INVENTION

The present invention provides a light source lighting circuit with such small and light circuit elements such as switching element, capacitor and the like that operate a discharge lamp in an excellent visual environment involving no flickering.

According to the present invention, an energy accumulating capacitor is connected through a charging switching element in parallel to a DC power source. A polarity inverting circuit is connected across the energy accumulating capacitor for applying a voltage of the energy accumulating capacitor across a discharge lamp with the polarity inverted alternately. A lamp starting high voltage generating circuit is connected to the discharge lamp for applying thereto a high voltage for starting the lamp, characterized in that the device is further provided with a control circuit for controlling the frequency of the polarity inverting circuit to be higher than a critical fusion frequency.

Other objects and advantages of the present invention shall become clear as the description of the invention proceeds with reference to preferred embodiments shown in accompanying drawings.

Figure 1:
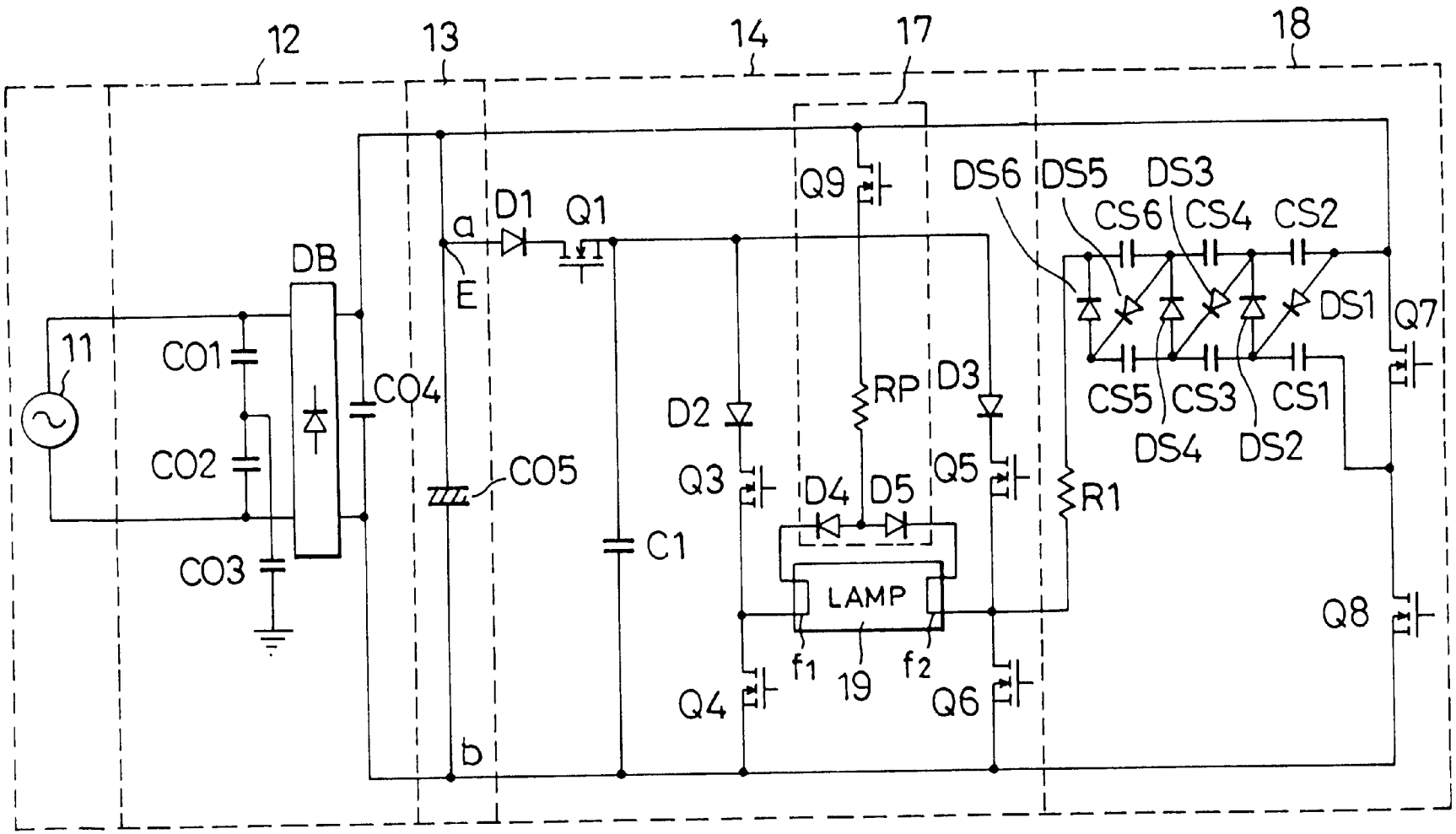
FIG. 1 is a circuit diagram of an embodiment of the light source power supply circuit according to the present invention.

While the present invention shall now be explained with reference to the embodiments shown in the drawings, it should be appreciated that the intention is not to limit the invention only to these embodiments but rather to include all possible alterations, modifications and equivalent arrangements possible within the scope of the invention as defined in appended claims.

DETAILED DESCRIPTION OF THE PREFERRED EMBODIMENTS

EMBODIMENT 1

Referring to FIGS. 1 to 6, Embodiment 1 of the present invention shall be explained. In this case, FIG. 5 in particular shows a basic circuit arrangement of the device in this embodiment, in which an AC power source 11 is connected through a rectifier circuit 12 to a smoothing circuit 13. A smoothing capacitor C, generates a DC voltage across output ends a and b of the smoothing circuit 13. Across the output ends a and b of the smoothing circuit 13 connected as a lighting circuit 14. The lighting circuit 14 is also connected to a control circuit 15 and, on the output side, through a switching circuit 16 to a lamp 19 that may be a fluorescent lamp or other similar preheating type discharge lamp.

Figure 6:
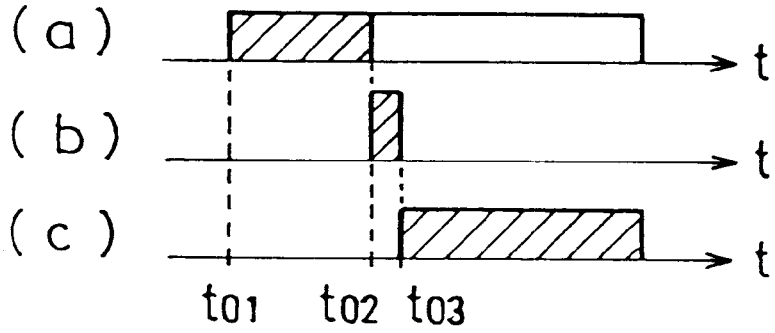
FIG. 6 is a time chart for explaining the operation of the device of FIG. 1.
Figure 5:
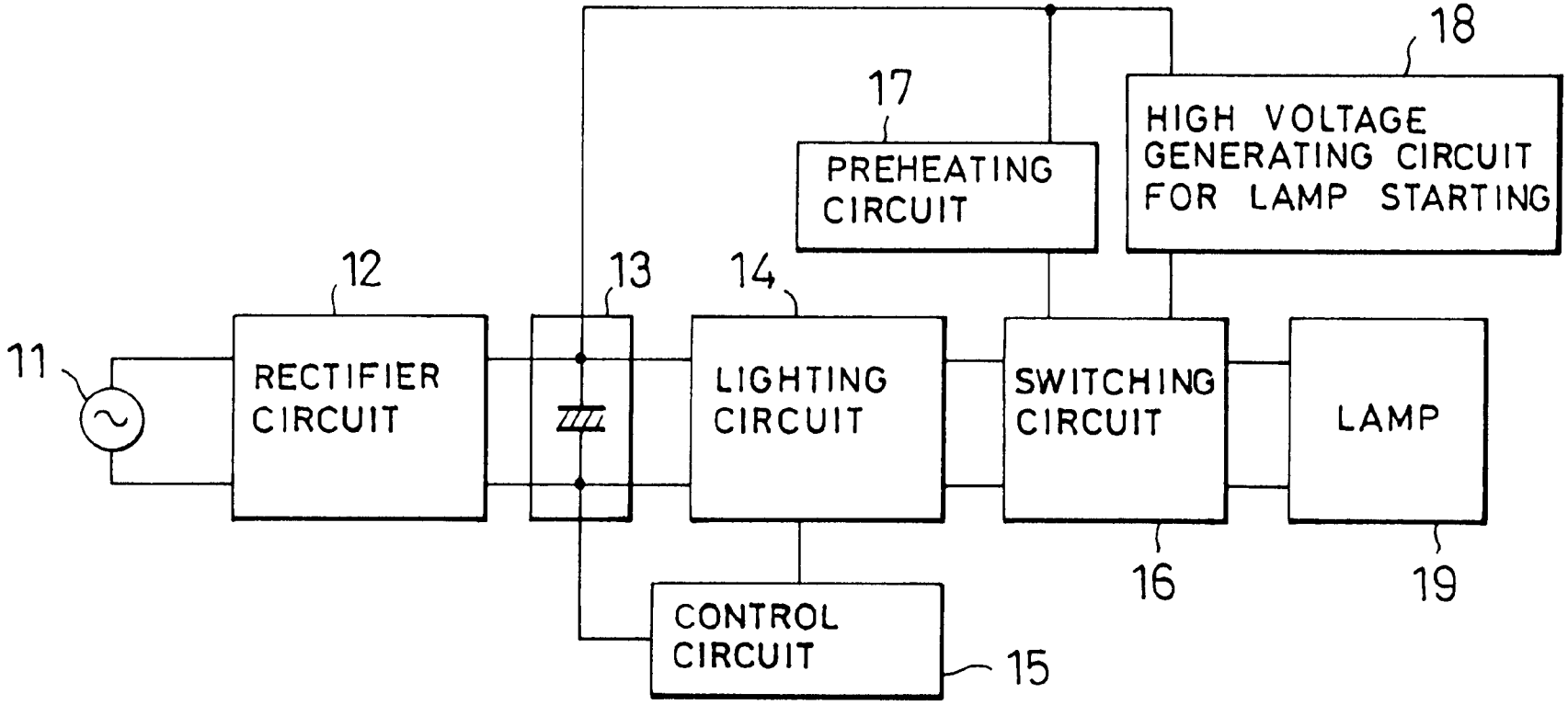
FIG. 5 is a block circuit diagram showing briefly a basic arrangement of the device shown in FIG. 1.

On the other hand, the output ends a and b of the smoothing circuit 13 are connected to each of a preheating circuit 17 and a lamp starting high voltage generating circuit 18. Outputs of these circuits 17 and 18 are provided to the switching circuit 16. With this arrangement of the device, the preheating circuit 17 preheats the discharge lamp 19 through the switching circuit 16 at time t01 as shown in FIG. 6(*a*), so as to lower the starting voltage of the lamp 19 for easier starting. Preheating time should be for about 1 second. After lapse of the preheating time, the lamp-starting high voltage generating circuit 18 is operated at time t02 as shown in FIG. 6(*b*) to have the discharge lamp 19 started and lighted at time t03 as shown in FIG. 6(*c*).

When the lamp 19 is a rapid start fluorescent lamp or the like, it is required to continue the preheating after the lighting but, in general, the operation of the preheating circuit 17 and high voltage generating circuit 18 is stopped after the lighting.

Referring next to FIG. 1, in particular, there is shown a practical circuit of the present embodiment, in which the rectifier circuit 12 for rectifying the power from the AC source 11 comprises a diode bridge DB and capacitors C01 to C04 for preventing noise and absorbing any surge. The smoothing circuit 13 comprises a smoothing capacitor C05, which generates a DC voltage E across both output ends a and b. In the lighting circuit 14, a series circuit of a diode D1, transistor Q1 comprising a MOSFET and an energy accumulating capacitor C1 is connected in parallel across the output ends a and b of the circuit 13. A series circuit of a diode D2 and transistors Q3 and Q4 of MOSFET's and a further series circuit of a diode D3 and transistor Q5 and Q6 of MOSFET's are connected in parallel across the energy accumulating capacitor C1 respectively. The preheating type discharge lamp 19 is connected at one end of each of both filaments f1 and f2 to a junction point between the transistors Q3 and Q4 and a junction point between the transistors Q5 and Q6. The respective transistors Q3 to Q6 forming a circuit for inverting the polarity of a voltage applied across the discharge lamp 19. This polarity inverting circuit acts simultaneously as the switching circuit 16 shown in FIG. 5 and forms the lighting circuit 14 along with the diode D1, transistor Q1 and energy accumulating capacitor C1.

A transistor Q9 of MOSFET in the preheating circuit 17 is connected to the output end a of the smoothing circuit 13. This transistor Q9 is also connected through a preheating resistor RP and forward directional connection of diode D4 to the other end of the filament f1. The transistor Q9 is also connected through the same preheating resistor RP and forward directional connection of diode D5 to the other end of the filament f2 of the discharge lamp 19.

Further across the output ends a and b of the smoothing circuit 13, a series circuit of transistors Q7 and Q8 formed by a MOSFET (not shown) in the lamp-starting high voltage generating circuit 18 is connected in parallel. An output end of the high voltage generating circuit 18 is connected to the junction point between the foregoing transistors Q5 and Q6. The lamp-starting high voltage generating circuit 18 further comprises a series circuit comprising a resistor R1 and a series connection in the forward direction of diodes DS1 to DS6 and connected between the junction point of the transistors Q5 and Q6 in the lighting circuit 14 and the output end a of the smoothing circuit 13. The transistor Q7 is connected in parallel to a series circuit of the diode DS1 and a capacitor CS1, and a Cockcroft-Walton circuit of a 4-time multiplied voltage and constituted by the capacitors CS1–CS6 and diodes DS1–DS6. The capacitor CS2 is connected in parallel to a series circuit of the diodes DS1 and DS2, and with the capacitor CS3 in parallel with a series circuit of the diode DS2 and DS3.

Figure 2:
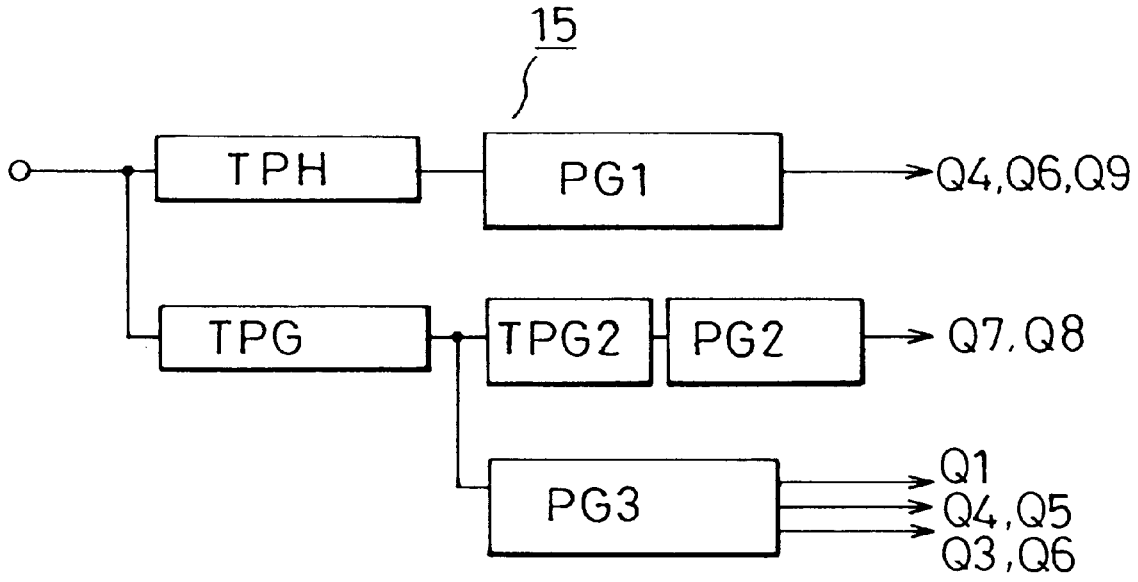
FIG. 2 is a block diagram of a control circuit that may be employed in the device of FIG. 1.

As shown in FIG. 2, the control circuit 15 for controlling the respective transistors Q1 to Q9 comprises a preheating timer TPH, preheating pulse generating circuit PG1, drive signal generating timer TPG, drive signal generating timer TPG2 for the high voltage generating circuit 18, and drive signal generating circuits PG2 and PG3.

Figure 3:
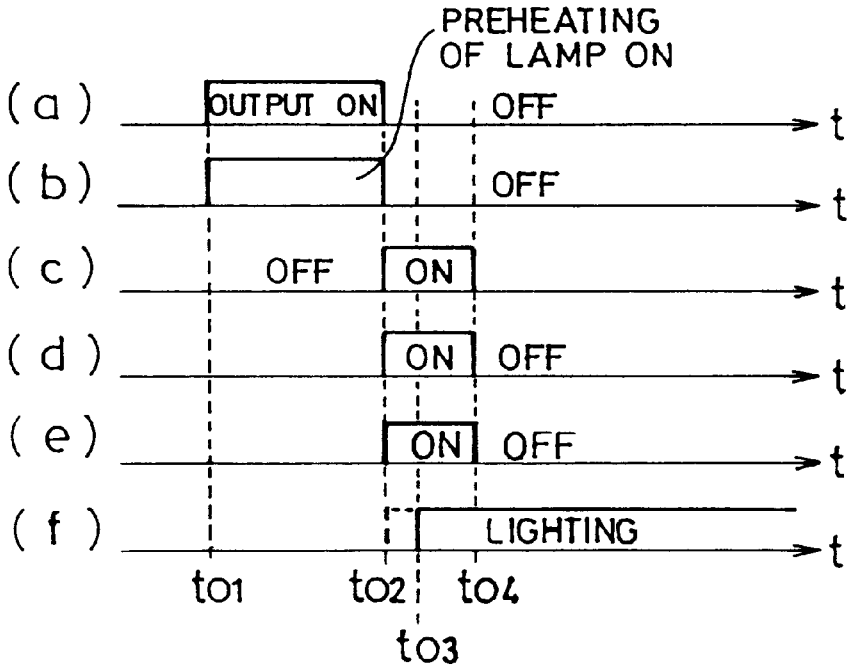
FIG. 3 is a time chart for explaining the operation of the control circuit in the device of FIG. 1.

The operation of the device in the present embodiment shall be described with reference to FIGS. 3 and 4. Now, as the power source 11 is connected at time t01, the preheating timer TPH and drive signal generating timer TPG start to operate. The preheating timer TPH starts a time limiting operation and at the same time turns its output ON as shown in FIG. 3(*a*). The drive signal generating timer TPG starts its time limiting operation while keeping its output in the OFF state as shown in FIG. 3(*c*). At this time, the discharge lamp 19 is optimally preheated as will be clear from a preheating period shown in FIG. 3(*b*).

During the ON output generating period with the ON output being received from the preheating timer TPH, the preheating pulse generating circuit PG1 provides drive signals to the gates of the transistors Q4, Q6 and Q9. The drive signals turn these transistors Q4, Q6 and Q9 ON, and currents are caused to flow through a path of the output end a of the smoothing circuit 13+transistor Q9+resistor RP+diode D4+one filament f1 of the discharge lamp 19+transistor Q4+output end a of the smoothing circuit 13 and through a path of the output end a of the circuit 13+transistor Q9+resistor RP+diode D5+the other filament f2 of the lamp 19+transistor Q6+output end b of the circuit 13, to preheat both filaments f1 and f2.

As the limited time of the preheating timer TPH is over at time t02, the output turns OFF so that no drive signal is generated by the preheating pulse generating circuit PG1 any more, and the transistors Q4, Q6 and Q9 are turned OFF. The limited time of the other drive signal generating time TPG is up at time t02 similarly to the lapse of the limited time of the preheating timer TPH, and the output of the timer TPG turns ON. Accompanying this turning ON of the timer TPG, the drive signal generating timer TPG2 starts its time limiting operation as shown in FIG. 3(*d*), and its output is turned ON. With the timer TPG2 ON, the drive signal generating circuit PG2 operates as shown in FIG. 3(*d*) to turn its output ON, which causes the drive signal generating circuit PG2 to operate as shown in FIG. 3(*e*) and generate the drive signals for alternately turning ON and OFF the transistors Q7 and Q8. These drive signals are applied to the gates of these transistors Q7 and Q8.

At the lamp-starting high voltage generating circuit 18, the transistor Q8 when turned ON causes a current to flow through a path of the output end a of the smoothing circuit 13+diode DS1+capacitor CS1+transistor Q8+output end b of the smoothing circuit 13, and the capacitor CS1 is charged. Next, as the transistor Q8 turns OFF and the transistor Q7 turns ON, the charge accumulated in the capacitor CS1 is caused to flow through the diode DS2+capacitor CS2+transistor Q7+capacitor CS1, and the capacitor CS2 is charged. As the transistor Q7 turns OFF and the transistor Q8 turns ON, a current flows from the output end a through the capacitor CS2+diode DS3+capacitor CS3+capacitor CS1+transistor Q8+output end b of the circuit 13, and the capacitor CS3 is charged.

With repetition of the alternate turning ON and OFF of the transistors Q7 and Q8 in this way, a voltage four times as large as a voltage E at the output end a of the smoothing circuit 13 is generated at the junction point of the capacitor CS6 and diode DS6. The voltage E is applied to one end of the filament f2 of the preheating type discharge lamp 19. At time t02 the drive signal generating circuit PG3 starts operating as shown in FIG. 3 (f) to generate drive signals for alternately turning ON and OFF two sets of the transistors Q3 and Q5 and the transistors Q4 and Q6. The drive signal generating circuit PG3 also sets at the same time a period in which the transistors Q3, Q5 and Q4, Q6 are all turned OFF, but the transistor Q1 is turned ON.

Figure 4:
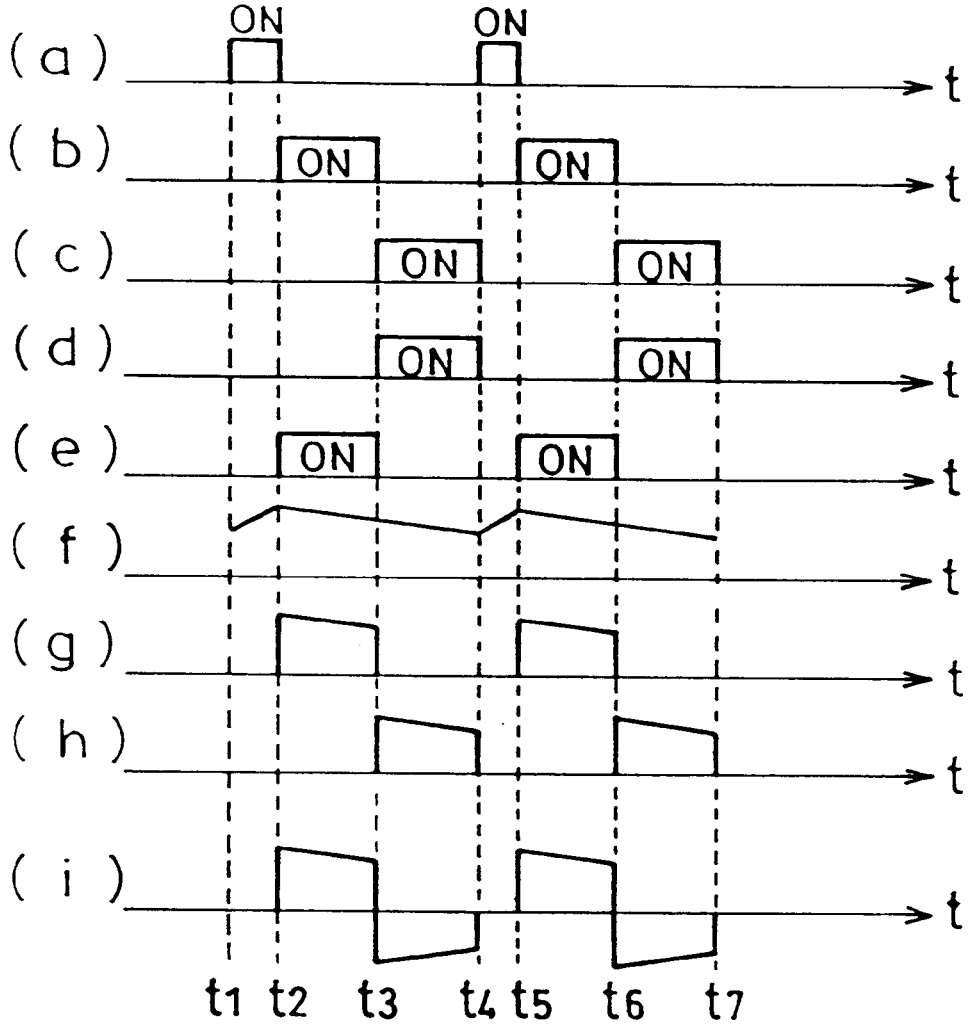
FIG. 4 is a time chart for explaining the operation for lighting the light source of the device of FIG. 1.

FIG. 4(*a*) shows the operation of the transistor Q1, and FIGS. 4(*b*) to 4(*e*) show the operation of the transistors Q3 to Q6, respectively. Here as the transistor Q1 turns ON at time t1, a current flows out of the output end a of the smoothing circuit 13 through a path of the diode D1+transistor Q1+energy accumulating capacitor C1+output end b of the circuit 13; and the energy accumulating capacitor C1 is charged. As next time t2 is reached, the transistor Q1 turns OFF but the transistors Q3 and Q6 turn ON, whereby the charge in the capacitor C1 is caused to be discharged through a circuit of the energy accumulating capacitor C1+diode D2+transistor Q3+preheating type discharge lamp 19+transistor Q6+capacitor C1.

Further when time t3 is reached, the transistors Q3 and Q6 turn OFF while the transistors Q4 and Q5 turn ON, whereby a remaining charge in the energy accumulating capacitor C1 is caused to be discharged through a circuit of the capacitor C1+diode D3+transistor Q5+discharge lamp 19+transistor Q4+capacitor C1.

In this manner the control circuit 15 operates to apply to both ends of the preheating type discharge lamp 19 a high frequency voltage of more than several tens of kHz with the polarity alternately inverted. At this time, a high voltage is being applied across the discharge lamp 19 by means of the lamp-starting high voltage generating circuit 18 through the resistor R1, so that the discharge lamp 19 starts at time t03 as shown in FIG. 3(*g*). The discharge current from the energy accumulating capacitor C1 is made to flow to the discharge lamp 19 as converted into the high frequency of several ten kHz, and the discharge lamp 19 is lighted at a higher frequency than the critical fusion frequency. After time t4 of FIG. 4, the foregoing operation from time to is repeated. FIG. 4(*f*) shows variation in the voltage across the energy accumulating capacitor C1, FIG. 4(*g*) shows a current flowing to the transistors. Q3 and Q6, FIG. 4(*h*) shows a current flowing to the transistors Q4 and Q5, and FIG. 4(*i*) shows the lamp current.

After the preheating type discharge lamp 19 has been lighted, the high voltage from the lamp-starting high voltage generating circuit 18 is no longer required. The limited time of the drive signal generating circuit 18 is also no longer required; and the limited time of the drive signal generating timer TPG2 is up at time t04 of FIG. 3 to turn its output OFF. The drive signal generating circuit PG2 then stops its operation, and its output drive signal to the gate of the respective transistors Q7 and Q8 disappears. Consequently, the transistors Q7 and Q8 are turned OFF, and the high voltage output from the lamp-starting high voltage generating circuit 18 also disappears.

In this way, upon connection of the power source at time T01 shown in FIG. 3, current is caused to flow for several seconds through the filaments f1 and f2 of the preheating type discharge lamp 19 to preheat them. Preheating makes it easier to obtain thermionic emission from the filaments f1 and f2. The starting voltage of the discharge lamp 19 is thereby lowered, and the discharge lamp 19 can be started and lighted ON and after time t02 upon which the high frequency of several tens of kHz is applied to the discharge lamp 19 (at time t03). The operation of the preheating circuit 17 and lamp-starting high voltage generating circuit 18 are no longer required after the lighting of the lamp 19 is stopped at times t02 and t04, respectively.

Since in the present Embodiment 1 the power supply circuit is constituted mainly by such switching elements, diode and the like semiconductor parts only as the capacitors and transistors, without requiring any choke coil or transformer as has been described, a small, light and thin type light source power supply circuit can be realized. Further, since no magnetic parts are employed, magnetic noise affects on computers and so on is reduced. Because the preheating type discharge lamp 19 can be lighted at the high frequency of several tens of kHz, the luminous efficiency in particular is elevated when the fluorescent lamp is employed. It is therefore possible to obtain a light source power supply circuit having high overall efficiency.

EMBODIMENT 2

In the foregoing arrangement, on the other hand, there is the possibility that the device is still insufficient for satisfying all combinations in relationship to the source voltage E and lamp voltage. That is, in the foregoing device, the higher voltage than the required lamp voltage for maintaining the lighting of light source must be applied to the preheating type discharge lamp 19 in every half cycle, and there arises a problem that, when it is attempted to flow a predetermined lamp current with the capacity value of the energy accumulating capacitor C1 adjusted, the lamp current is caused to be remarkably varied or rendered to be pulse-shaped depending on the magnitude of the capacity of the capacitor C1, as shown in FIG. 7B.

Figure 7A:
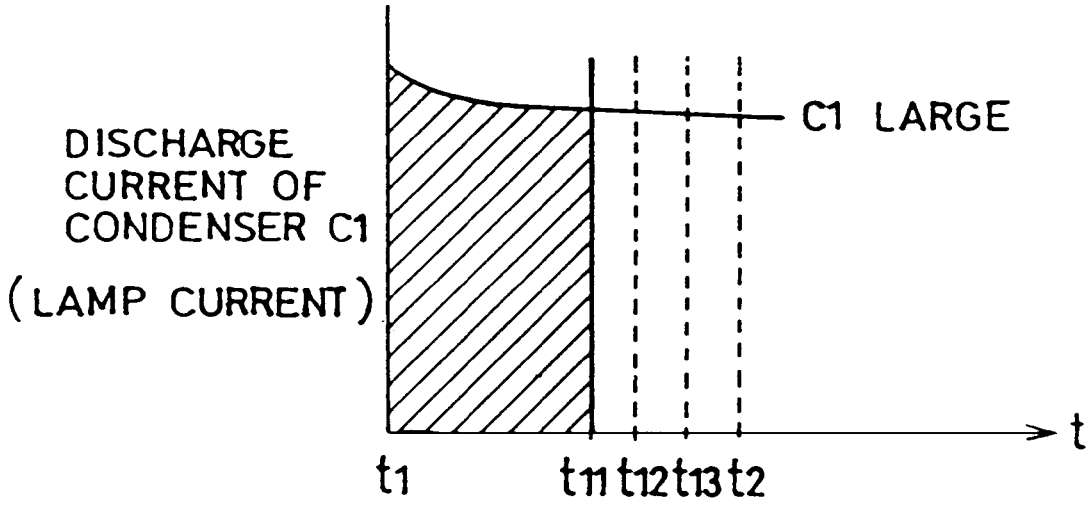
FIG. 7A is a diagram for explaining the relationship between discharge time of the energy accumulating capacitor and the lamp current in another embodiment of the present invention.
Figure 7B:
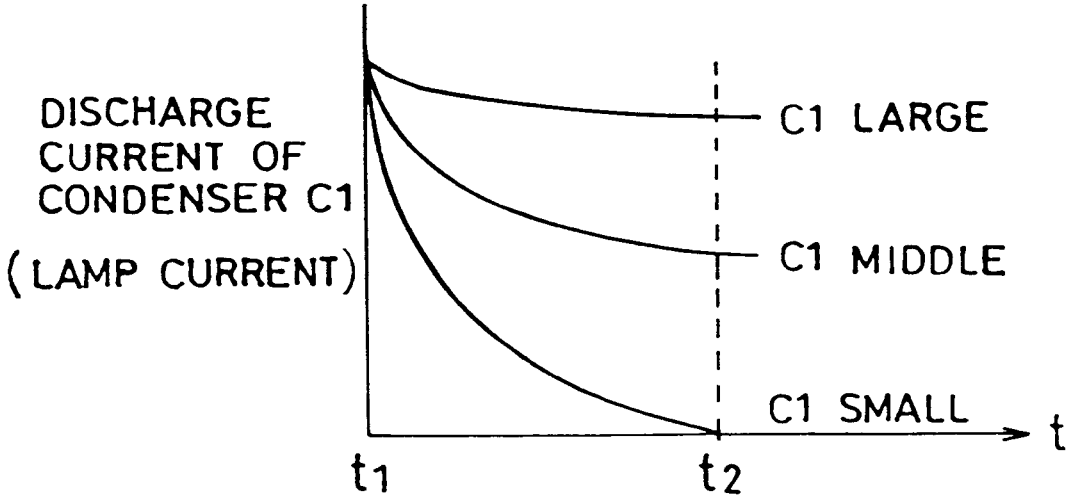
FIG. 7B is a diagram for explaining the relationship between the capacitance of the energy accumulating capacitor and the lamp current in the device of FIG. 7A.

In FIG. 7A, there is shown a lamp current waveform in the case when duty of the lamp current in the half cycle period is controlled, in which the shaded zone is to be the lamp current. This allows a flat lamp current of a non-sharp pulse shape to be provided, stably even upon fluctuation of the energy accumulating capacitor C1. The present embodiment is provided for removing any such risk as in the above.

Figure 8:
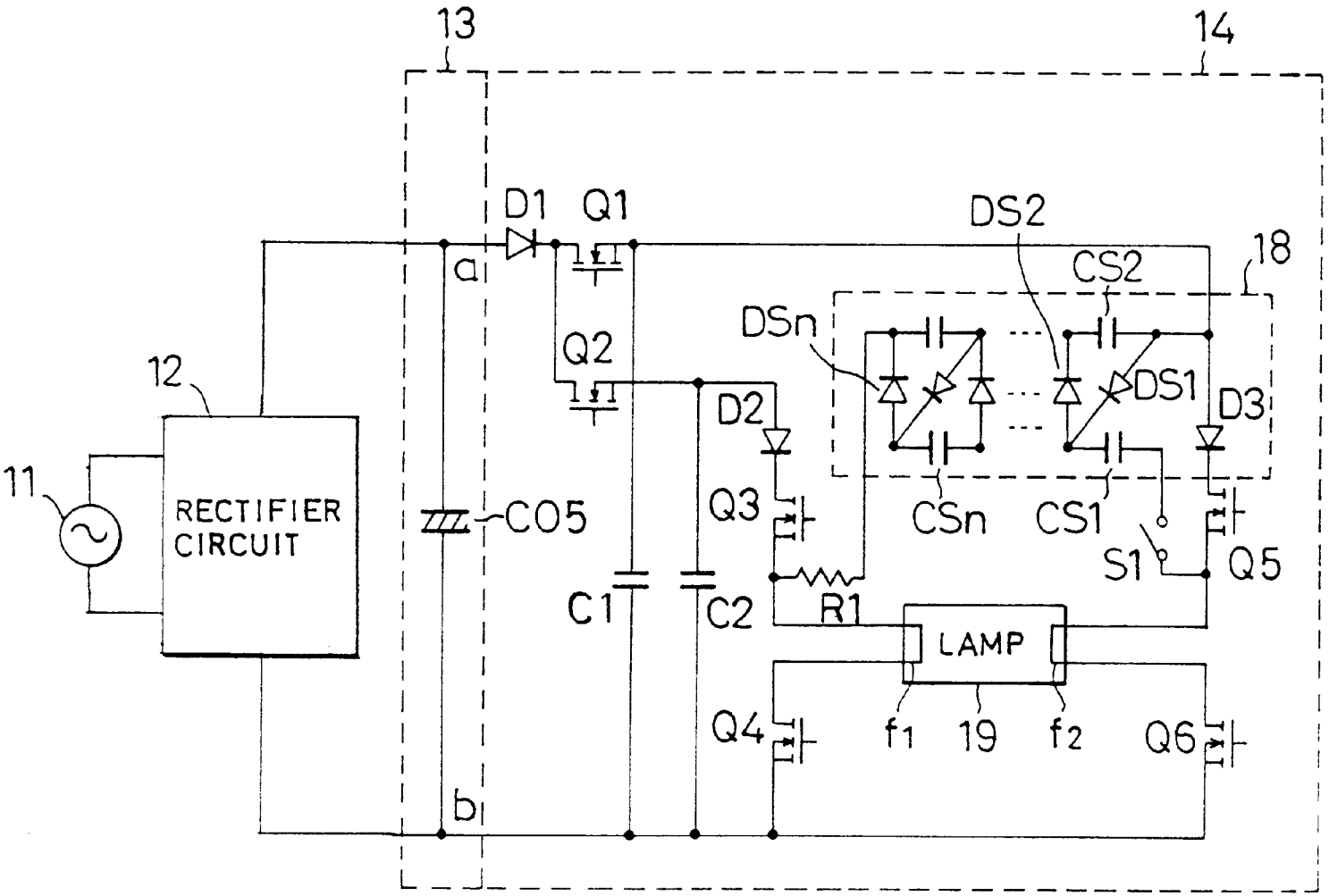
FIG. 8 is a circuit diagram of the device in the embodiment of FIG. 7.

The present Embodiment 2 shall be described in detail with reference to FIGS. 7–11. As shown in FIG. 8, in particular, the transistors Q5 and Q6 in the polarity inverting circuit are made to act also as the transistors Q7 and Q8 in the high voltage generating circuit 18. The filament f1 of the preheating type discharge lamp 19 is inserted between the transistors Q3 and Q4 of the polarity inverting circuit while the filament f2 of the lamp 19 is inserted between the transistors Q5 and Q6. The filaments f1 and f2 are preheated by a current made to flow to the filament f1 by simultaneously turning ON the transistors Q3 and Q4 and by a current made to flow to the filament f2 by simultaneously turning ON the transistors Q5 and Q6. That is, the preheating circuit is constituted by means of a partial utilization of the polarity inverting circuit.

Figure 9:
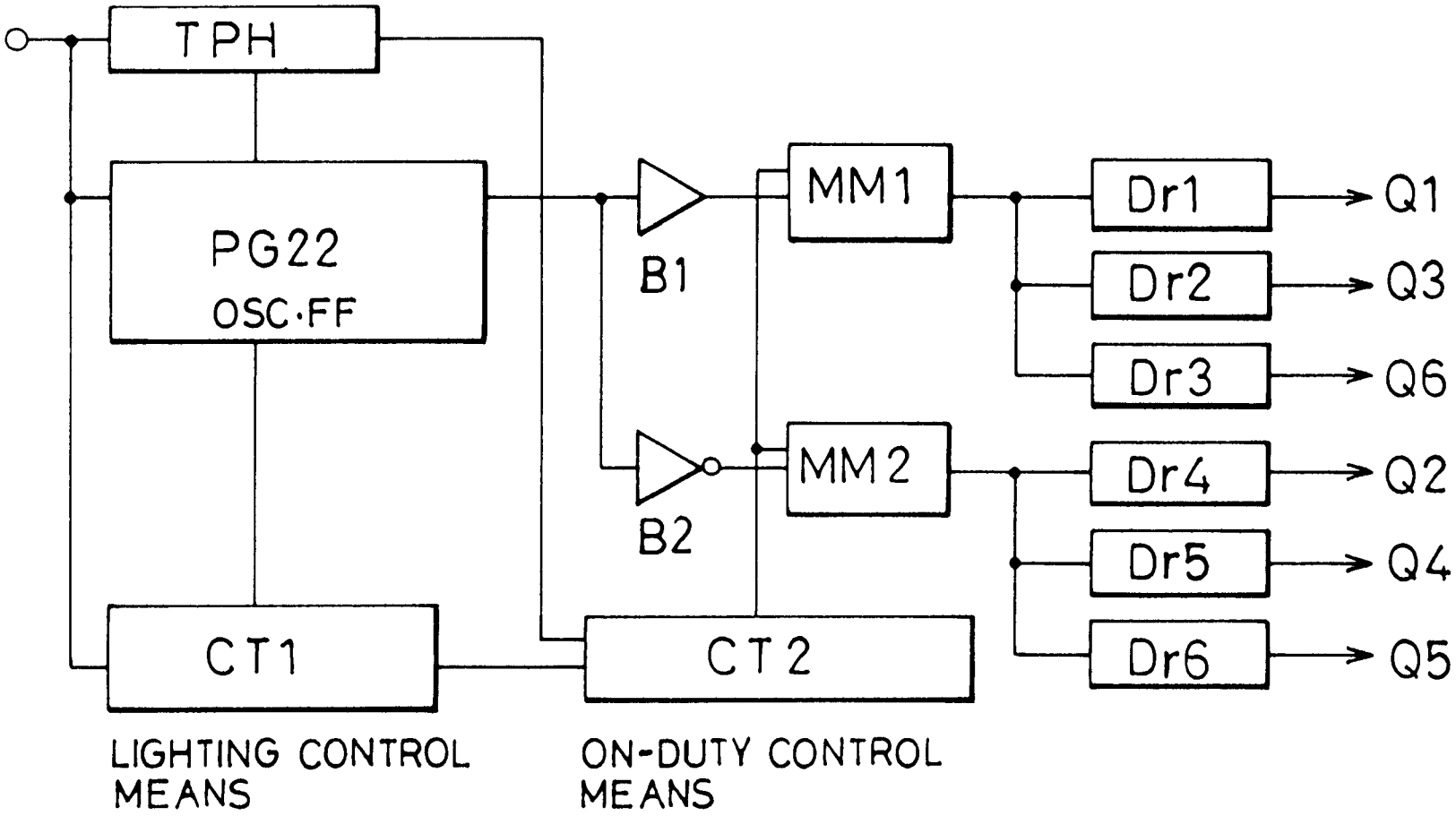
FIG. 9 is a block diagram of a control circuit employed in the device of FIG. 7.

The control circuit 15 comprises, as shown in FIG. 9, a preheating timer TPH, a drive signal generating circuit PG22 comprising an oscillator and a bistable multivibrator, a lighting control circuit CT1, ON-duty control circuit CT2, monostable multivibrators MM1 and MM2, a buffer B1, a NOT gate B2, and drivers Dr1–Dr6.

Figure 10:
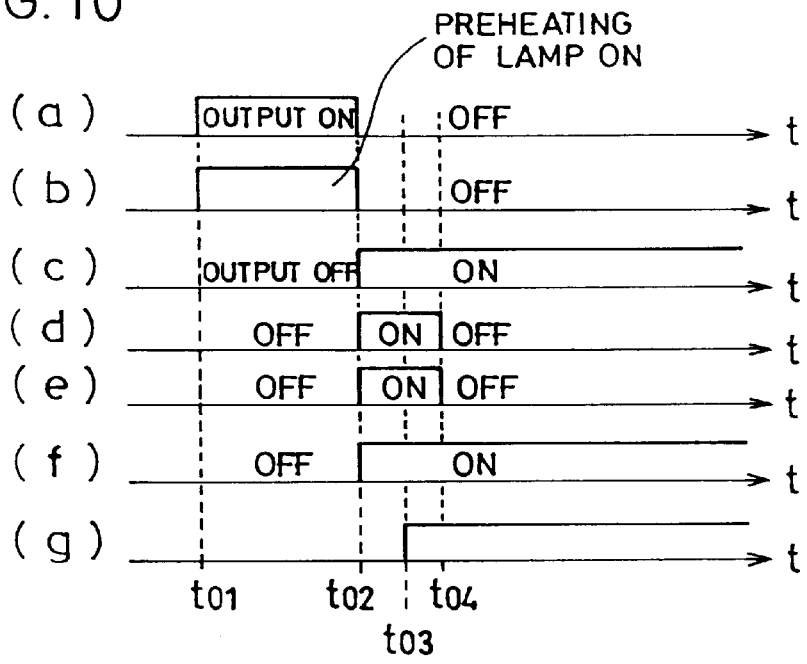
FIG. 10 is a time chart for explaining the operation of the control circuit employed in the device of FIG. 7.

Next, the operation of the present embodiment shall be detail with reference to FIG. 10. As the power source 11 is connected at time T01, first, the control circuit 15 starts its operation as shown in FIG. 10, but the preheating timer TPH starts its time-limiting operation to turn its output ON as shown in FIG. 10(*a*). Simultaneously with the power source connection, the lighting control circuit CT1 is actuated, and the drive signal generating circuit PG22 generates pulse signals of a constant cycle under the control of this lighting control circuit CT1. On the other hand, under the control of the lighting control circuit CT1, the ON-duty control circuit CT2 sets a time constant of the monostable multivibrators MM1 and MM2 so as to render the ON-duty of output pulses of the monostable multivibrators MM1 and MM2 to be narrower during ON period of the preheating timer TPH. At the same time the multivibrators MM1 and MM2 provide narrow ON-duty pulses in response to a synchronous signal received through the lighting control circuit CT1 from the drive signal generating circuit PG22.

Here, the pulse signals generated by the pulse generating circuit PG22 sent through the buffer B1 to the monostable multivibrator MM1 act as a trigger signal thereof, a signal from the ON-duty control circuit CT2 is added to the trigger signal, and the monostable multivibrator MM1 generates pulse signals of a constant cycle. Further, a pulse signal from the signal generating circuit PG22 is provided as a trigger signal through the NOT gate B2 to the monostable multivibrator MM2. A signal from the ON-duty control circuit CT2 is added to the trigger signal, and the monostable multivibrator MM2 generates pulse signals of a constant cycle and narrower than in the case of the lighting. The transistors Q1–Q6 are all thereby caused to be turned ON with the narrow duty, during the preheating period. That is, the transistor Q2 and the transistors Q3 and Q4 are turned ON to cause the preheating current to flow to the filament f1. Also, the transistor Q1 and the transistors Q5 and Q6 are turned ON to cause the preheating current to flow to the filament f2. The period in which the currents flow to both filaments f1 and f2 is less than 1 second of the ON period of the output of the preheating timer TPH.

During this preheating period, the transistors Q1–Q6 are all made to be ON though with the narrow duty, and the DC voltage across the output ends a and b of the smoothing circuit 13 is all applied to the filament f1 and f2 of the preheating type discharge lamp 19. As a measure for preventing this from occurring, it is possible, for example, to insert a parallel circuit of a starting resistance and switch in series between the rectifier circuit 12 and the smoothing circuit 13 to control the preheating current with the inserted switch made OFF during the preheating period but made ON at time t02 of FIG. 10 at which the preheating is terminated so as to short-circuit the starting resistance.

Now, as the preheating period is set as shown in FIG. 10(*b*) during the ON period of the output from the preheating timer TPH and the output is turned OFF when the limited time of the preheating timer TPH is up at time t02, the control circuit 15 shifts its control operation to the lighting mode to expand the ON duty of output pulses of the monostable multivibrators MM1 and MM2 by the action of the lighting control circuit CT1 and ON-duty control circuit CT2, and to have alternately ON and OFF pulses provided out of the drivers Dr1–Dr3 and Dr4–Dr6. An input end of the lamp-starting high voltage generating circuit 18 is simultaneously connected in parallel to a series circuit of the diode D3 and transistors Q5 through a switching element So, and the high voltage generating circuit 18 starts operating as shown in FIG. 10(*c*) to generate the high voltage. The switching element S1 comprises a semiconductor element and is provided for causing a starting timer provided in the control circuit 15, for example, to perform a time limiting operation for a predetermined period after a falling of the output of the preheating timer TPH and to be ON during the period of this time limiting operation, as in FIG. 10(*d*). The high voltage generated by the lamp starting high voltage generating circuit 18 during this ON period is applied through the resistor R1 across the preheating type discharge lamp 19 for a short period of FIG. 10(*e*). The discharge lamp 19 is lighted at time t03, for example, in this short period (t02–t04) as shown in FIG. 10(*g*).

Figure 11:
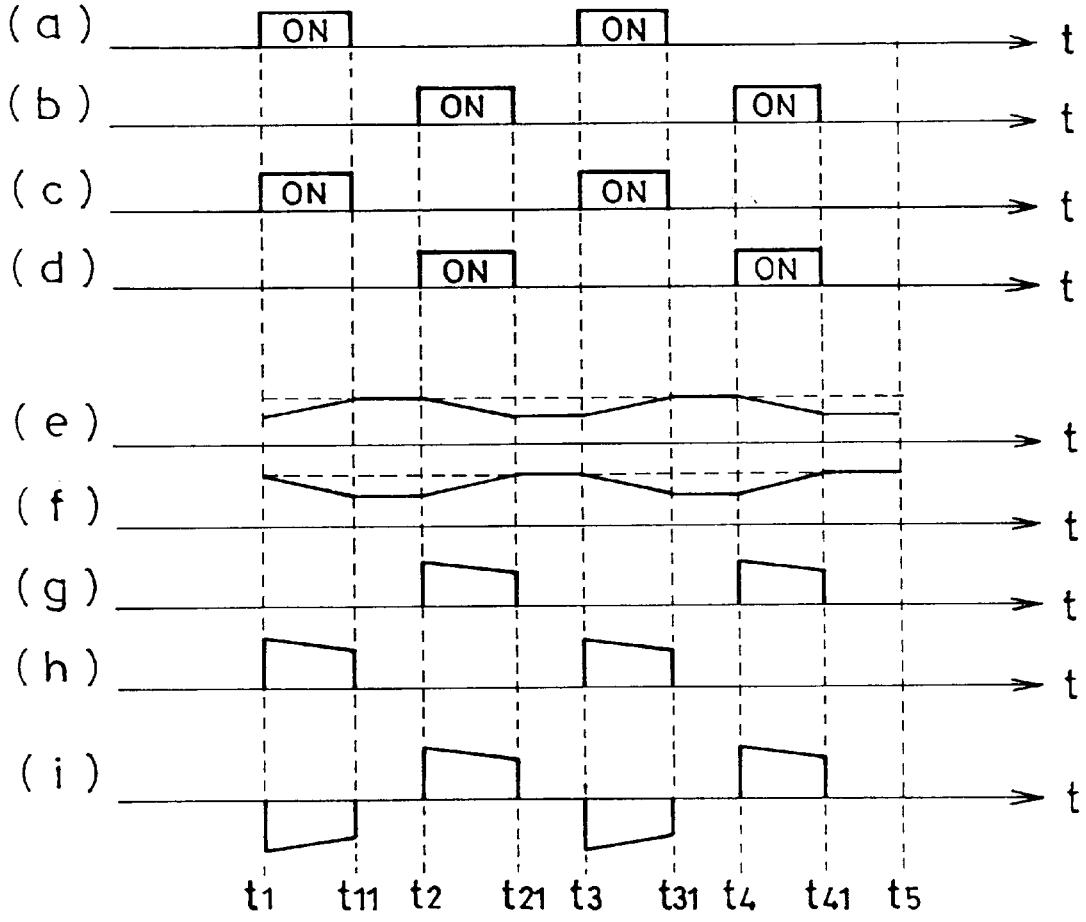
FIG. 11 is a time chart for explaining the lighting operation in the device of FIG. 7.

FIG. 11 shows operational waveforms at respective parts under the lighting mode. FIG. 11(*a*) shows the operation of the transistor Q1. FIG. 11(*b*) shows the operation of the transistor Q2. FIG. 11(*c*) shows the operation of the transistors Q3 and Q6. FIG. 11(*d*) shows the operation of the transistors Q4 and Q5. The transistors Q1–Q6 are controlled to be alternately ON in every half cycle of the high frequency so that the transistors Q1, Q3 and Q6 will be ON in a period of time t1–t11; but the transistors Q2, Q4 and Q5 will be ON in a period of time t2–t21. The voltages across the capacitors C1 and C2 are caused to vary due to the charging and discharging as shown in FIGS. 11(*e*) and 11(*f*), respectively. Then, a current is made to flow to the transistors Q4 and Q5 forming the polarity inverting circuit as shown in FIG. 11(*g*). A current is also made to flow to the transistors Q3 and Q6 as shown in FIG. 11(*h*), and a lamp current as shown in FIG. 11(*i*) flows to the discharge lamp 19. In order to vary the duty of the charge and discharge of the energy accumulating capacitors C1 and C2, it is possible to render the lamp current value to be variable further extensively by altering the ON period of the transistors Q1, Q3 and Q6 or Q2, Q4 and Q5.

For the preheating and starting, the arrangement in the foregoing embodiment may be employed in the present embodiment. Further, the arrangement of the control circuit 15 may not be limited to that of FIG. 9. With the present embodiment constituted as described above, it is possible to omit the preheating transistor to render the arrangement to be inexpensive. The ON duty of the transistors Q3 to Q6 is narrowed further than in the case of the lighting, so as to be able to prevent any excessive preheating from occurring. Even in an event where a fluorescent lamp is elongated so that it requires a higher lamp voltage, a stable and flat lamp current can be supplied. Further, since the transistors in the polarity inverting circuit are made to act also as the transistors in the lamp-starting high voltage generating circuit 18 as in FIG. 8, the cost reduction and circuit simplification can be further attained in addition to the effect of the omission of the preheating transistors. Further, after the lighting, a dimming may also be realizable by means of the adjustment of the ON duty of the transistors Q3–Q6.

EMBODIMENT 3

Figure 12:
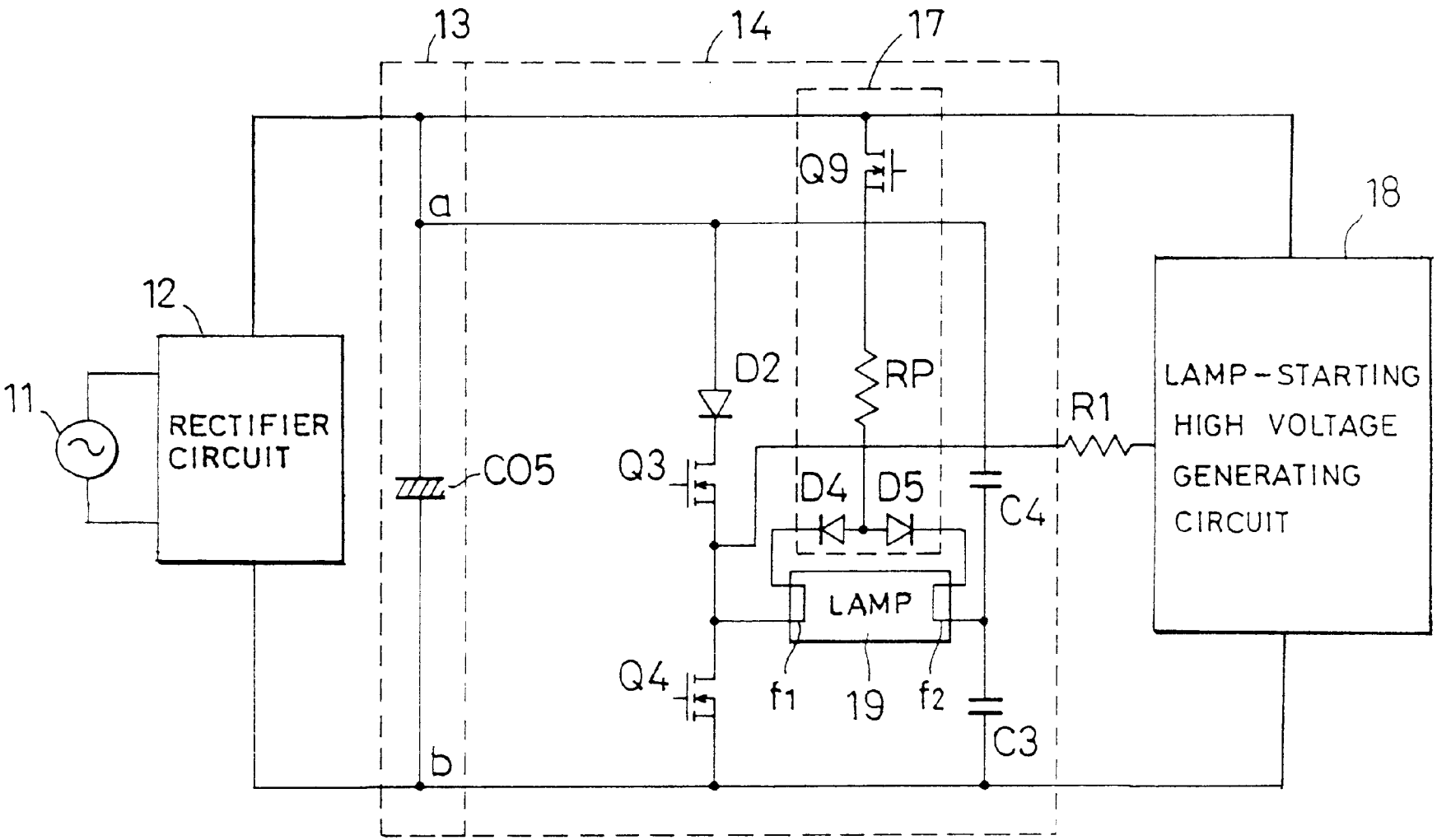
FIG. 12 is a circuit diagram showing another embodiment of the present invention.

The present Embodiment 3 is constituted by forming a so-called half bridge type polarity inverting circuit by replacing the transistors Q5 and Q6 of the polarity inverting circuit in the foregoing Embodiment with capacitors C3 and C4 as shown in FIG. 12. In this case the present embodiment is advantageous in that the polarity inverting circuit is simplified by the reduction in the number of transistors. The energy accumulating capacitor C1, which may be replaced by the above capacitors C4 and C3 is not required to be a separate component. The transistor Q1 is made unnecessary. The control circuit (omitted in FIG. 12) can be also simplified in this embodiment of the invention, and the entire device can be made inexpensive.

Now, in the circuit of FIG. 12, the transistors Q3 and Q4 are alternately turned ON and OFF by means of an optimum control circuit (not shown). Provided that the transistor Q3 is now turned ON, a current for charging the capacitor C3 and simultaneously acting as a lamp current for the preheating type discharge lamp 19 are caused to flow through the output end a of the smoothing circuit 13+diode D2+transistor Q3+discharge lamp 19+capacitor C3+output end b of the smoothing circuit 13. Provided next that the transistor Q3 turns OFF and the transistor Q4 turns ON, a current for charging the capacitor C4 and simultaneously acting as the lamp current for the discharge lamp 19 is caused to flow in an opposite direction to that in the above, through the output end b of the smoothing circuit 13+capacitor C4+discharge lamp 19+transistor Q4+output end b of the smoothing circuit 13.

Further, the charge in the capacitor C3 previously charged is caused to flow through the capacitor C3+discharge lamp 19+transistor Q4+capacitor C3, as superposed on the foregoing current so as to increase the lamp current for the discharge lamp 19.

In next period, that is, in the state where the transistor Q3 is ON and the transistor Q4 is OFF, the charging current for the capacitor C3 acting also as the lamp current for the preheating type discharge lamp 19 is caused to flow through the output end a of the circuit 13+discharge lamp 19+capacitor C3+output end b of the smoothing circuit 13. Simultaneously, the charge accumulated in the capacitor C4 during the ON period of the transistor Q4 is discharged through the capacitor C4+diode D2+transistor Q3+discharge lamp 19+capacitor C4 as superposed on the current flowing to the lamp 19, so that the lamp current for the discharge lamp 19 is increased.

Thereafter, the above-described operation is repeated, and the current having higher frequency than the critical fusion frequency and having the polarity alternately inverted is made to flow to the preheating type discharge lamp 19 to maintain its lighting. The high voltage from the lamp-starting high voltage generating circuit 18 is applied through the resistor R1 to the junction between the transistors Q3 and Q4. It is also possible to attain a correction of any unbalance in the lamp current and its stabilization, and the dimming, by means of the ON duty control for the transistors Q3 and Q4 as actuated from the lamp-starting high voltage generating circuit 18 through the resistor R1.

EMBODIMENT 4

Figure 13:
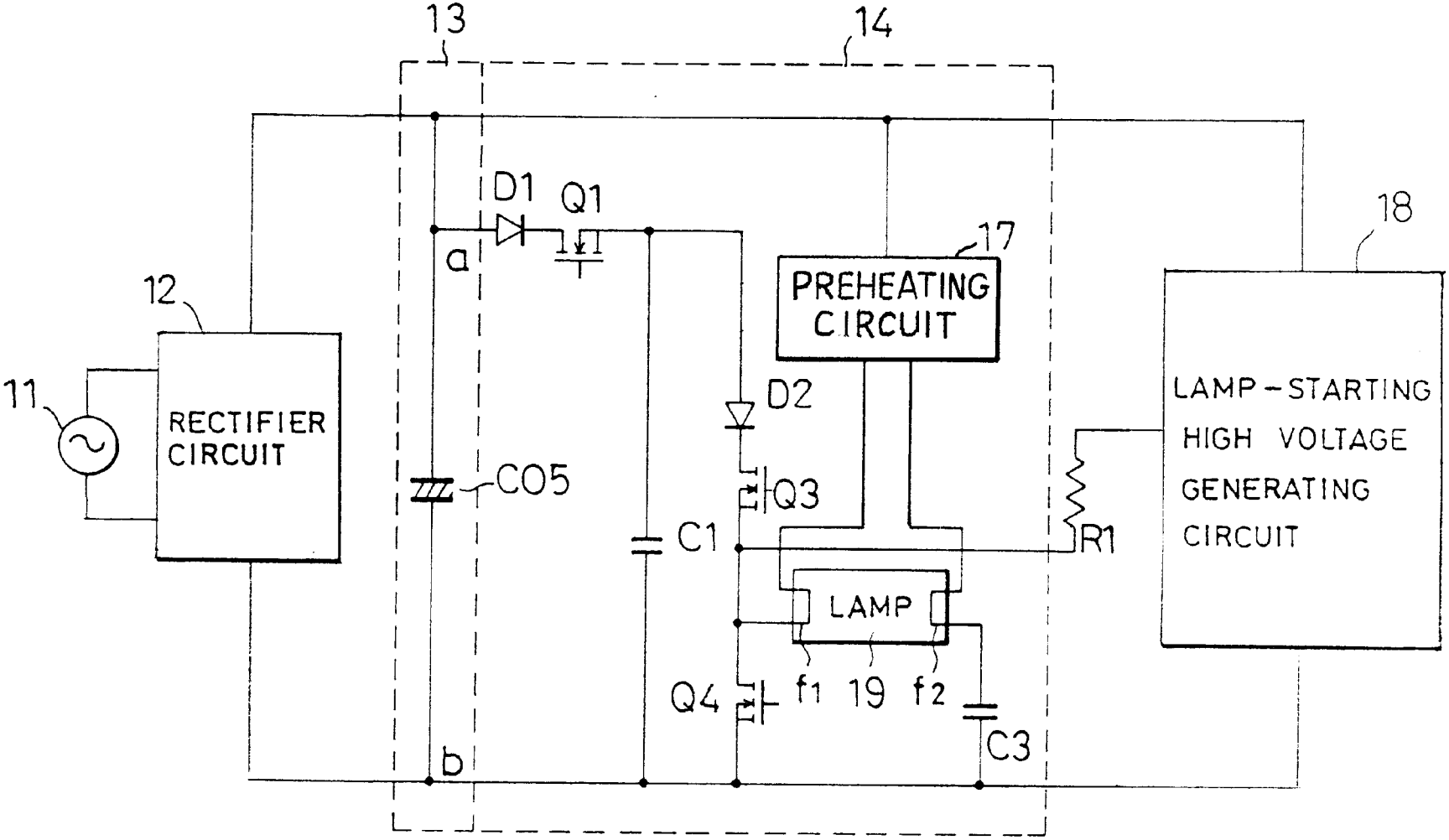
FIG. 13 is a circuit diagram of another embodiment of the present invention.

In this present embodiment, as shown in FIG. 13, the diode D3 in Embodiment 1 is omitted, the two transistors Q5 and Q6 are replaced by a single capacitor C3, and the high voltage output end of the lamp-starting high voltage generating circuit 18 is connected through the resistor R1 to the junction point between the transistors Q3 and Q4. The arrangement in other respects is substantially the same as Embodiment 1. That is, the rectifier circuit 12, preheating circuit 17, lamp-starting high voltage generating circuit 18 and control circuit 15 are the same in their practical arrangement, and are therefore not shown in FIG. 13.

Figure 14:
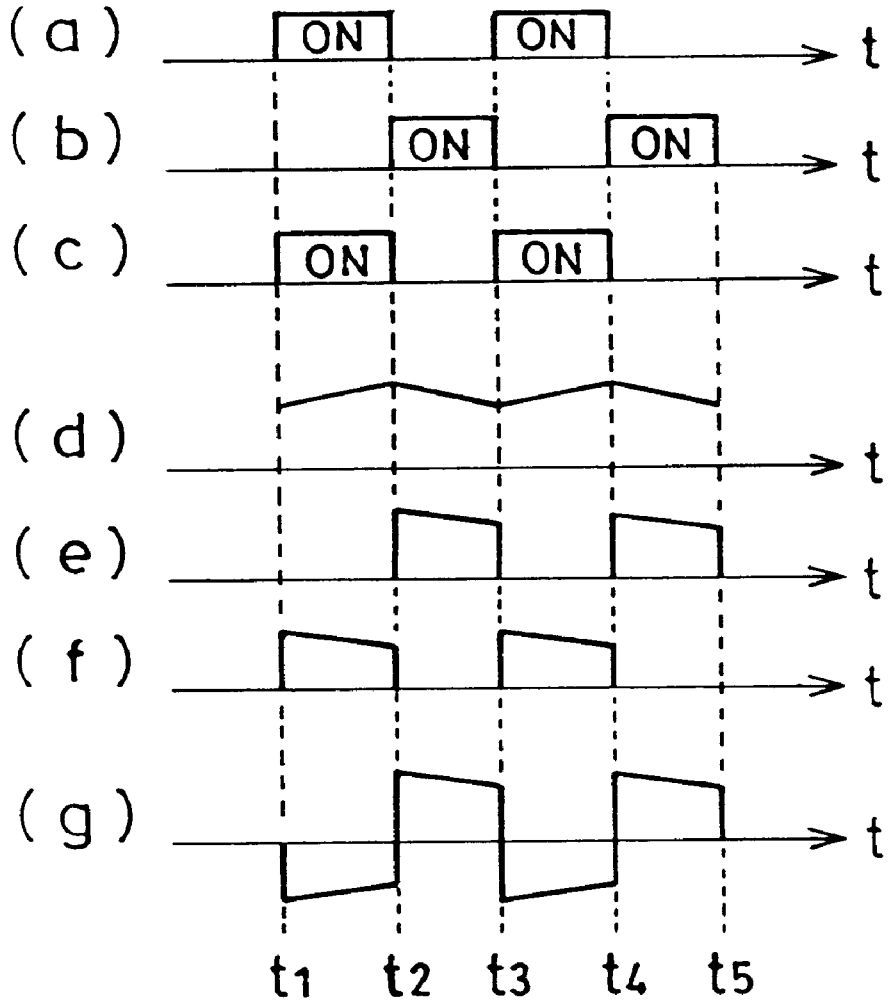
FIG. 14 is a time chart for explaining the lighting operation in the device shown in FIG. 13.

Next, the operation of Embodiment 4 shall be described with reference also to FIG. 14. First, the transistors Q1, Q3 and Q4 are controlled by the drive signals from the control circuit 15 so that the transistor Q1 will be ON and OFF simultaneously with the transistor Q4 as shown in FIGS. 14(*a*) and 14(*c*) while the transistor Q3 will be alternately ON and OFF with respect to the transistors Q1 and Q4 as shown in FIG. 14(*b*).

In this case, the filaments f1 and f2 of the preheating type discharge lamp 19 are sufficiently preheated by means of the preheating circuit 17 under the control by the control circuit 15 after the connection of the power source. Thereafter the transistors Q1 and Q4 are turned ON at time t1. Then the current flows through the output end a of the smoothing circuit 13+diode D1+transistor Q1+energy accumulating capacitor C1+output end b of the circuit 13 to have the capacitor C1 charged.

As the transistors Q1 and Q4 turn OFF and the transistor Q3 turns ON at time t2, the charge accumulated up to a voltage E in the energy accumulating capacitor C1 is discharged in a path of the capacitor C1+diode D2+transistor Q3+discharge lamp 19+capacitor C3+capacitor C1, so as to form the lamp current for the preheating type discharge lamp 19 and to simultaneously charge the capacitor C3.

As time t3 is reached, the transistors Q1 and Q4 are turned ON; but the transistor Q3 is turned OFF, so that the capacitor C1 is charged again. On the other hand, the charge accumulated previously in the capacitor C3 is made to be discharged through the capacitor C3+discharge lamp 19+transistor Q4+capacitor C3; and the lamp current of the polarity inverse to the above is formed. After time t4, this operation is repeated, and the high frequency current exceeding several tens of kHz, that is, higher than the critical fusion frequency is made to flow through the preheating type discharge lamp 19 to have the lamp lighted highly efficiently.

FIG. 14(*d*) shows the voltage across the energy accumulating capacitor C1. FIG. 14(*e*) shows a current flowing to the transistor Q3. FIG. 14(*f*) shows a current flowing through the transistor Q4. FIG. 14(*g*) illustrates the lamp current. Since in the present embodiment the transistors Q1, Q3 and Q4 are turned ON and OFF at a high speed such as several tens of kHz, the capacitors C1 and C3 for forming the lamp current to the discharge lamp 19 may be of a small capacitance, and the same advantages as in Embodiment 1 can be also attained since no magnetic parts are employed.

Further in the present embodiment, the transistors Q5 and Q6 and diode D3 in Embodiment 1 can be made unnecessary, and only the capacitor C3 having small capacitance is employed. Therefore this arrangement is more advantageous than that of Embodiment 1 in the capability of further minimizing the size and costs. Further, since the lamp current to the discharge lamp 19 involves no pause in the ON period of the transistor Q1 in contrast to Embodiment 1, which is advantageous in that the lamp voltage can be prevented from rising, and the lamp can be more efficiently lighted.

Figure 15:
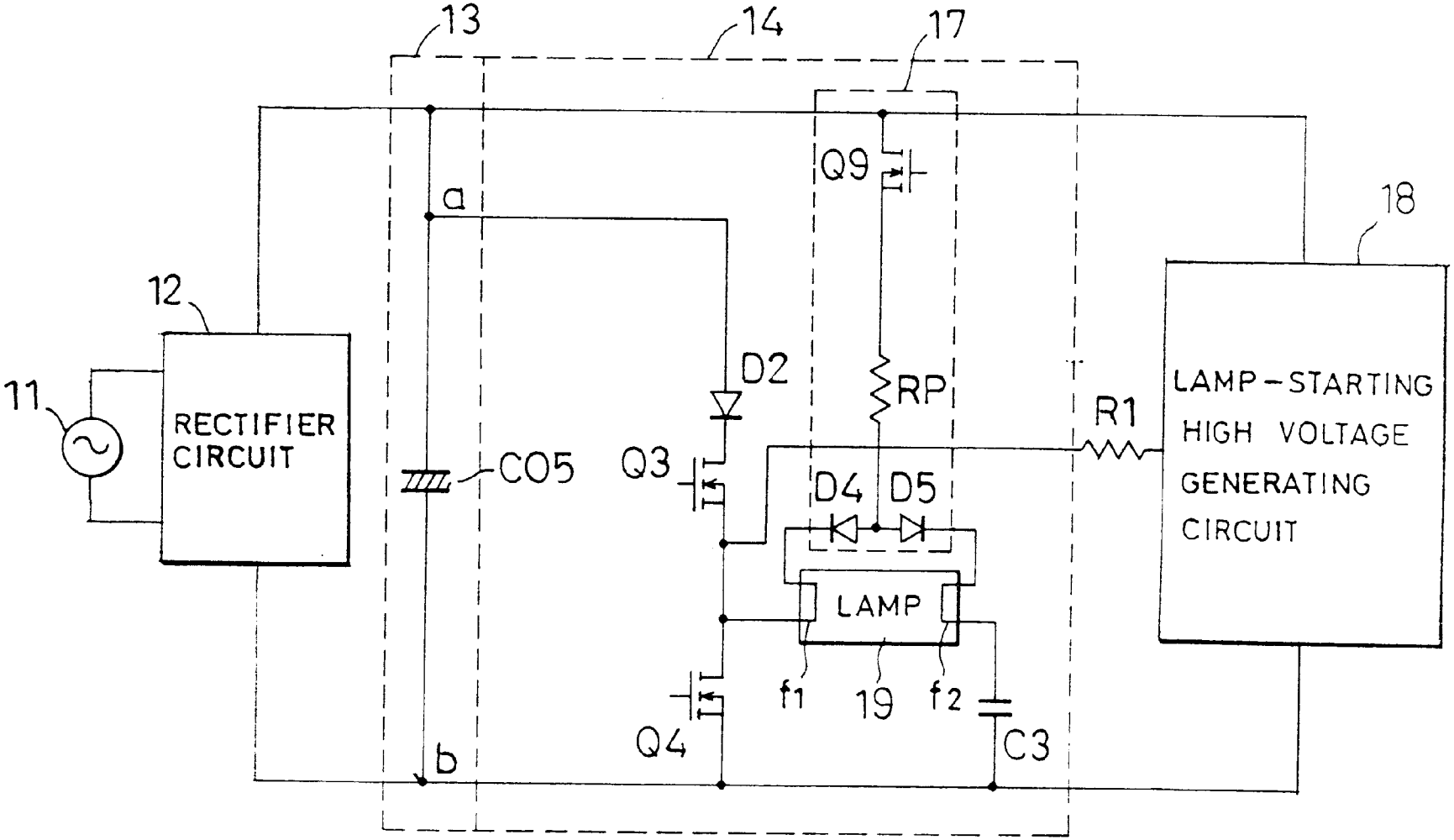
FIG. 15 is a circuit diagram of still another embodiment of the present invention.

On the other hand, it is possible to further simplify the circuit of FIG. 13 to be similar to FIG. 12. As shown in FIG. 15 the diode D1 and transistor Q1 are removed and replaced with a short-circuit. The capacitor C1 is also removed so that the device can be made inexpensive and useful.

That is, in the circuit of FIG. 15, the ON state of the transistor Q3 causes the charging current for the capacitor C3 and acts also as the lamp current for the preheating type discharge lamp 19 to flow through the output end a of the smoothing circuit 13+diode D2+transistor Q3+discharge lamp 19+capacitor C3+output end b of the circuit 13. As the transistor Q3 turns OFF and the transistor Q4 is ON next, the charge accumulated in the capacitor C3 is discharged through the capacitor C3+discharge lamp 19+transistor Q4+capacitor C3. A lamp current inverse directional to the previous lamp current is made to flow to the discharge lamp 19, and the high frequency lighting of the discharge lamp 19 is attained.

The high voltage from the lamp-starting high voltage generating circuit 18 is applied through the resistor R1 across the preheating type discharge lamp 19 in the OFF period of the transistor Q4, and the lamp 19 is started and lighted.

EMBODIMENT 5

In the foregoing Embodiments 1 and 4, the discharge of the energy accumulating capacitor C1 is carried out twice with respect to each charge thereof. Therefore there arises a difference in the capacitor voltage in the initial state of the discharge between the first occurring discharge and the second occurring discharge. A slight unbalance occurs between the positive and negative currents though the high frequency current is made to flow to the discharge lamp 19. This does not rise to become any remarkable problem in the discharge lamp of a small tube length, and the unbalance is rather effective to prevent any moving striation from being prominent. In the case of the discharge lamp of a large tube length, there arises a risk of causing a dark end phenomenon that renders an end part of the lamp tube darkened.

In order to prevent this unbalance from occurring in the current, it may be possible to employ in the circuit of FIG. 1 an arrangement for discharging the energy accumulating capacitor C1 once with each charge and a further arrangement for performing the discharge twice with respect to every charge. The operating sequence of these arrangements are alternately changed, which causes the control circuit 15 in the circuit of FIG. 1 to be slightly complicated and increases the pause period in the lamp current of the discharge lamp 19. In the latter arrangement, there is no increase in the lamp current pausing period, whereas the former arrangement causes, in the circuit of FIG. 1, the transistor Q1 turned ON to charge the capacitor C1 and then causes the transistors Q3 and Q6 turned ON to discharge the charge C1 through the discharge lamp 19. Next, the transistors Q3 and Q6 are turned ON to have the charge in the capacitor C1 discharged through the discharge lamp 19. Then, the transistor Q1 is turned ON to charge the capacitor C1, and next the transistors Q5 and Q4 are made ON to have the charge in the capacitor C1 discharged through the discharge lamp 19. Consequently, there is no lamp current flowing during the period in which the energy accumulating capacitor C1 is charged, and the pause period increases.

The latter arrangement operates in the circuit of FIG. 1 to first turn the transistor Q1 ON to charge the energy accumulating capacitor C1. Then, when the transistor Q1 is turned OFF, the charge accumulated in the capacitor C1 is discharged through both of a path (I) of the capacitor C1+diode D2+transistor Q3+discharge lamp 19+transistor Q6+capacitor C1 and a path (II) of the capacitor C1+diode D3+transistor Q5+discharge lamp 19+transistor Q4+capacitor C1 first in the order of the paths (I) and (II). After next charging the energy accumulating capacitor C1, the charge is discharged through both paths but in a reversed order of the paths (II) and (I) this time, so that the unbalance in the lamp current is eventually prevented.

With the above-described operation, the pausing period of the lamp current is caused to occur as limited to the charging time of the energy accumulating capacitor C1 only. In the circuit arrangement of FIG. 13, further, it is possible to eliminate the unbalance in the lamp current by means of the duty control. It is of course possible to also flatten the lamp current waveform by means of the duty control, while rendering the current to be proper.

Figure 16:
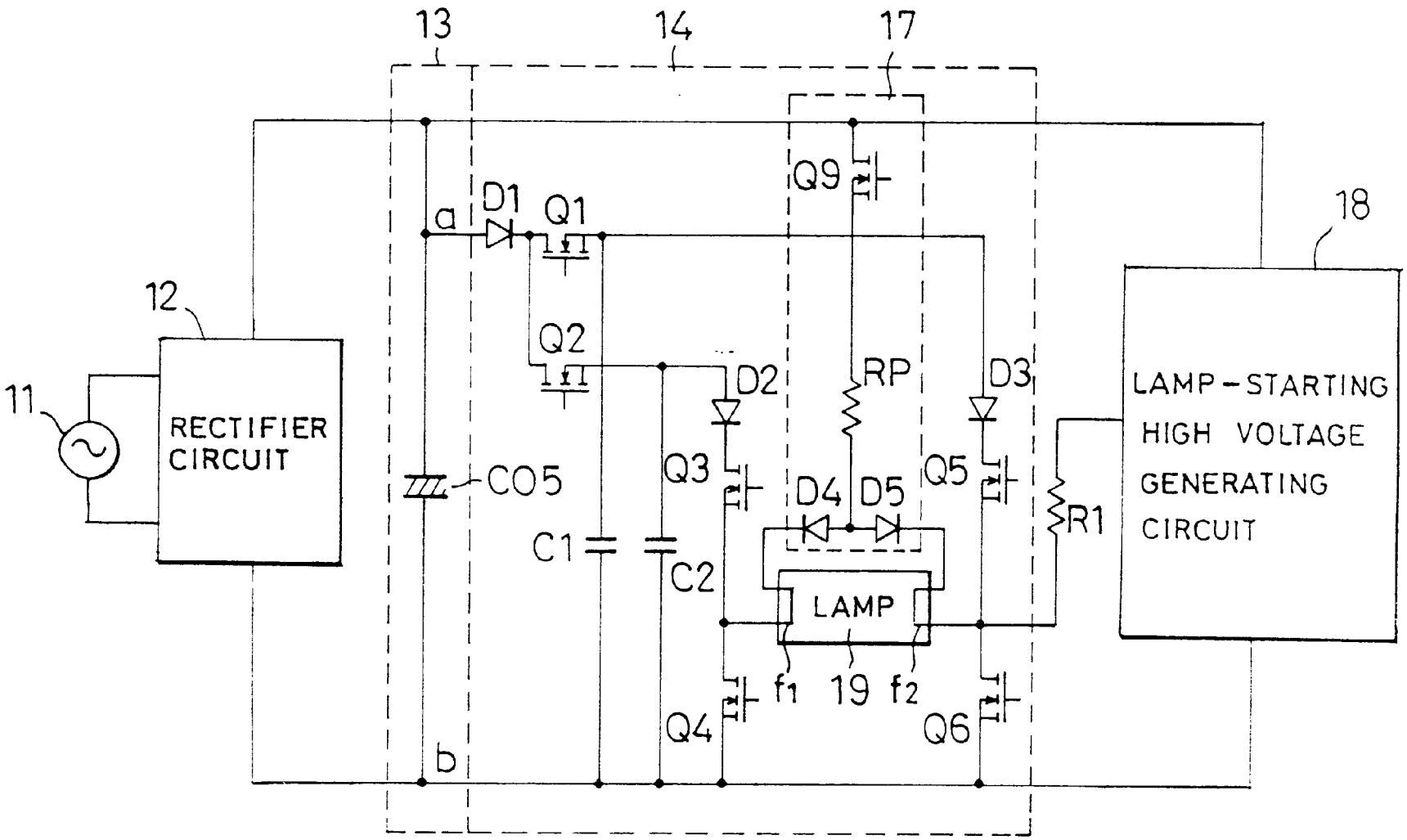
FIG. 16 is a circuit diagram showing the device in another embodiment of the present invention.
Figure 17:
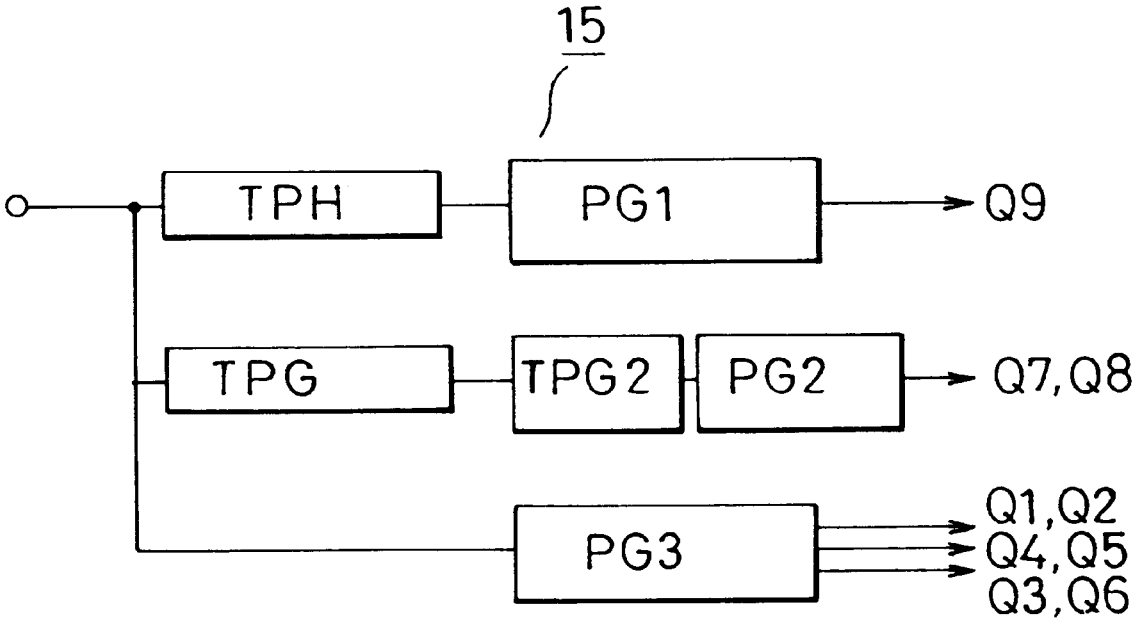
FIG. 17 is a block circuit diagram of a control circuit employed in the device of FIG. 16.

Now, the present Embodiment 5 is different from Embodiment 1 in respect that, as shown in FIG. 16, the energy accumulating capacitor is comprised of two capacitors C1 and C2 respectively connected through each of the switching transistor Q1 and Q2 and commonly through the diode D1 to both output ends a and b of the smoothing circuit 13. The capacitor C1 is connected in parallel through the diode D3 to the series circuit of transistors Q5 and Q6 in the polarity inverting circuit, and the capacitor C2 is connected in parallel through the diode D2 to the series circuit of transistors Q3 and Q4. While the control circuit 15 is basically of an identical arrangement to the control circuit 15 of Embodiment 1, as shown in FIG. 17, there is a distinction from Embodiment 1 in that the drive signal generating PG3 is actuated simultaneously with the connection of the power source to provide the drive signals for turning alternately ON and OFF each set of the transistors Q4, Q5 and Q2 and the transistors Q3, Q6 and Q1. Therefore, the preheating pulse generating circuit PG1 provides the drive signal only to the gate of the transistor Q9 in the preheating circuit 17. For other arrangements than the preheating circuit 17 and lamp-starting high voltage generating circuit 18, it is possible to employ the same arrangements as those in Embodiment 1.

Figure 18:
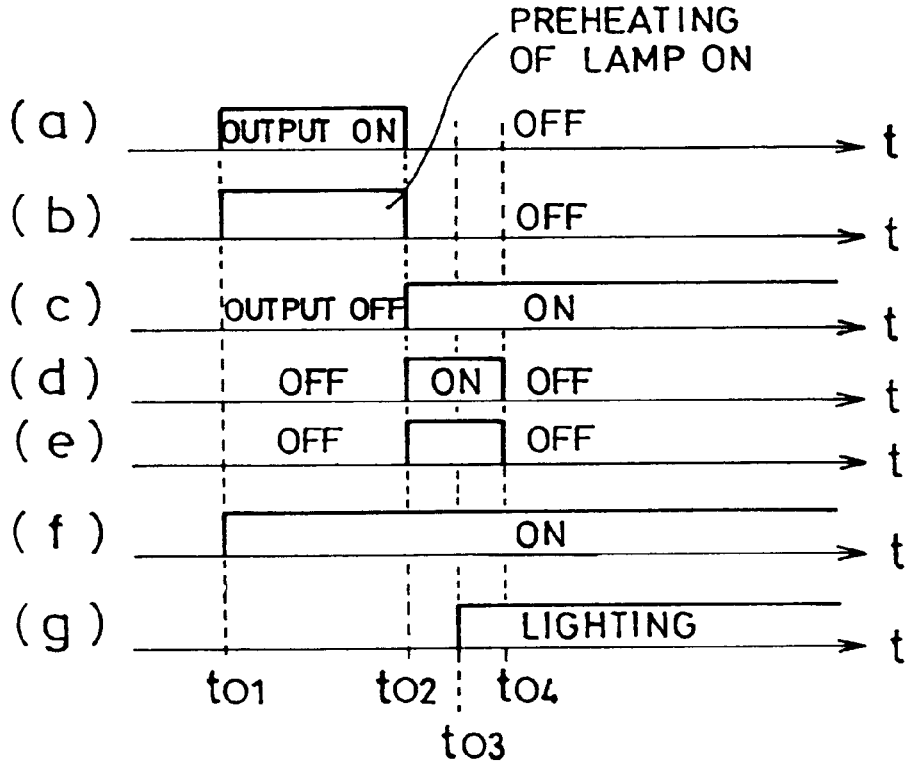
FIG. 18 is a time chart for explaining the operation of the control circuit in the device of FIG. 16.

The operation of the present embodiment shall be described with reference to FIGS. 18 and 19. Now, as the power source is connected at time t01 of FIG. 18, the preheating timer TPH, drive signal generating circuits TPG and PG3 in the control circuit 15 start operating. At the same time when its time limiting operation starts, the TPH provides the output ON as shown in FIG. 18(*a*), and the drive signal generating time TPG starts its time limiting operation with the output kept in OFF state as shown in FIG. 18(*c*). In response to the ON output of the preheating timer TPH, the preheating pulse generating circuit PG1 provides the drive signal to the gate of the transistor Q9 during the period in which the ON output is generated. On the other hand, the drive signal generating circuit PG3 provides its output drive signals to the respective gates of the set of transistor Q1 as shown in FIG. 19(*a*) and transistors Q3 and Q6 as shown in FIG. 19(*c*) and of the set of the transistor Q2 as shown in FIG. 19(*b*) and transistors Q4 and Q5 as shown in FIG. 19(*d*) so as to drive them.

Figure 19:
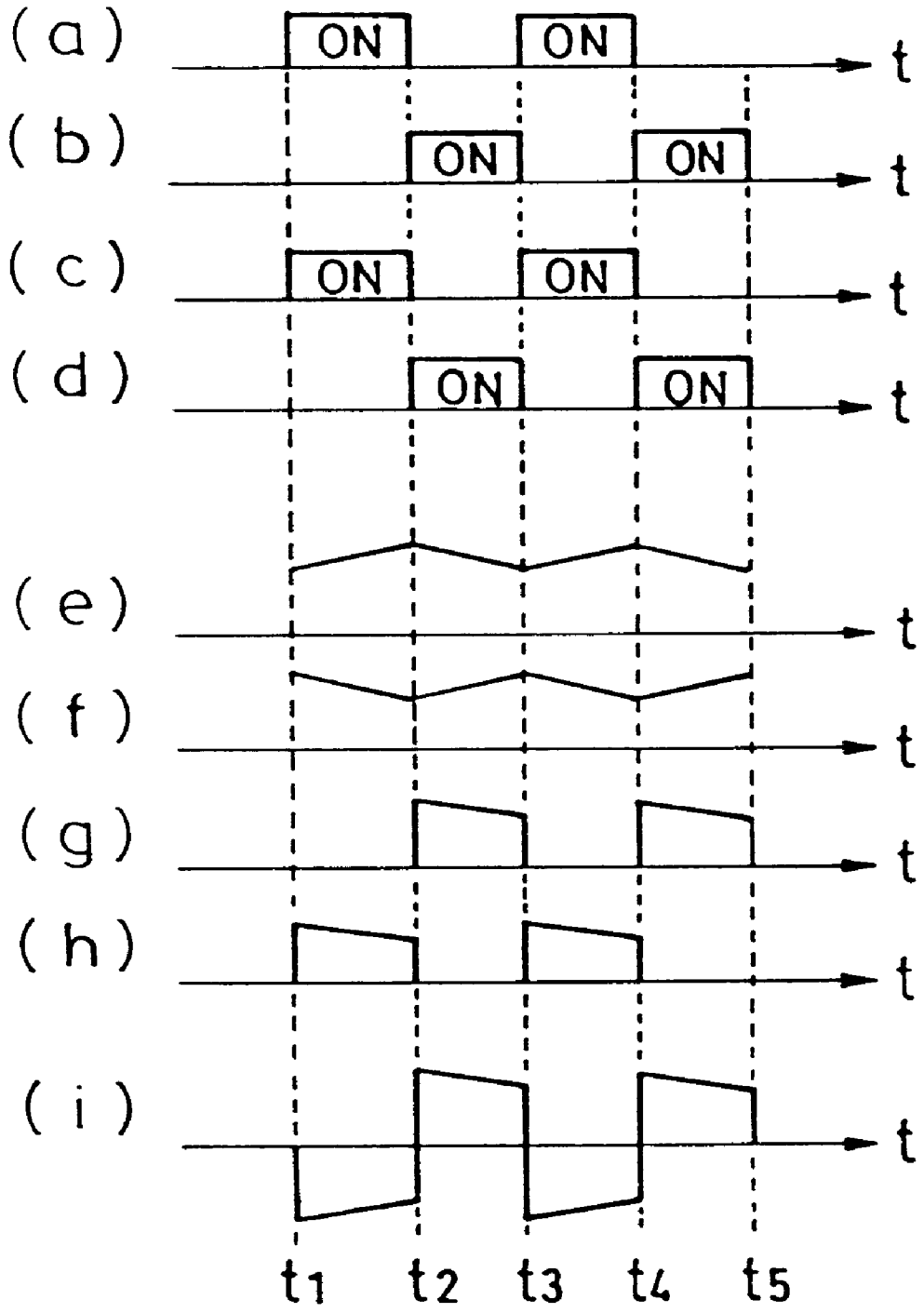
FIG. 19 is a time chart for explaining operation of the device of FIG. 16.

As the set of the transistors Q1, Q3 and Q6 of the lighting circuit 14 and the transistor Q9 in the preheating circuit 17 are simultaneously turned ON at time t1 in FIG. 19, a current is caused to flow through a path of the output end a of the smoothing circuit 13+transistor Q9+resistor RP+diode D5+filament f2 of the discharge lamp 19+transistor Q6+output end b of the circuit 13 and, at the same time, the transistor Q1 is turned ON to have the capacitor C1 charged. While the transistor Q3 is also in ON state, no current flows thereto because the transistor Q2 is in OFF state immediately after the connection of the power source; and there is no charge in the energy accumulating capacitor C2.

At time t2 in FIG. 19, next the transistors Q1, Q3 and Q6 are turned OFF; and the other set of transistors Q2, Q4 and Q5 are turned ON. The transistor Q9 being in the ON state causes a current to flow through a path of the output end a of the smoothing circuit 13+transistor Q9+resistor RP+diode D4+filament f1 of the discharge lamp 19+transistor Q4+ and output end b of the smoothing circuit 13. That is, the preheating currents are made to flow through the filaments f1 and f2 of the preheating type discharge lamp 19 every time when the transistors Q4 and Q6 alternately turn ON and OFF so that the filaments are alternately preheated.

When the transistor Q2 turns ON, the energy accumulating capacitor C2 is charged but, because the transistor Q3 is OFF, there flows no current of discharge from the capacitor C2. On the other hand, the charge in the energy accumulating capacitor C1 which has been previously charged is nearly discharged through a path of the capacitor C1+diode D3+transistor Q5+discharge lamp 19+transistor Q4+capacitor C1. However, because no high voltage required for starting the lamp 19 is provided from the lamp-starting high voltage generating circuit 18, the lamp 19 is not lighted, and the high frequency voltage of which the polarity is alternately inverted is applied across the discharge lamp 19 by the charge in the energy accumulating capacitors C1 and C2.

At time t02 in FIG. 18, the transistor Q9 turns OFF to interrupt the preheating current. Simultaneously therewith the transistors Q7 and Q8 in the lamp-starting high voltage generating circuit 18 are actuated by the outputs of the drive signal generating circuit PG2 as has been described for Embodiment 1. The high voltage is applied through the resistor R1 to the preheating type discharge lamp 19. At time t03 the lamp 19 is kept lighted at a high frequency above several tens of kHz, that is, higher than the critical fusion frequency, without involving any pausing period in the lamp current as in Embodiment 1.

Because the energy accumulating capacitors C1 and C2 alternately repeat the charge and discharge in the present embodiment, the positive and negative lamp currents flowing to the preheating type discharge lamp 19 can be well balanced by setting the capacity of both capacitors C1 and C2 to be identical. The arrangement does not cause any darkened end phenomenon even when employed with the discharge lamp of elongated tube. Since the moving striation can be prevented by means of a flow of currents that are very slightly asymmetric, this can be realized by setting the capacity of both capacitors C1 and C2 to be just slightly different. Further, as these energy accumulating capacitors C1 and C2 are alternately charged, the current from the power source flows continuously, and the coefficient of utilization of the power source can be improved.

EMBODIMENT 6

Figure 20:
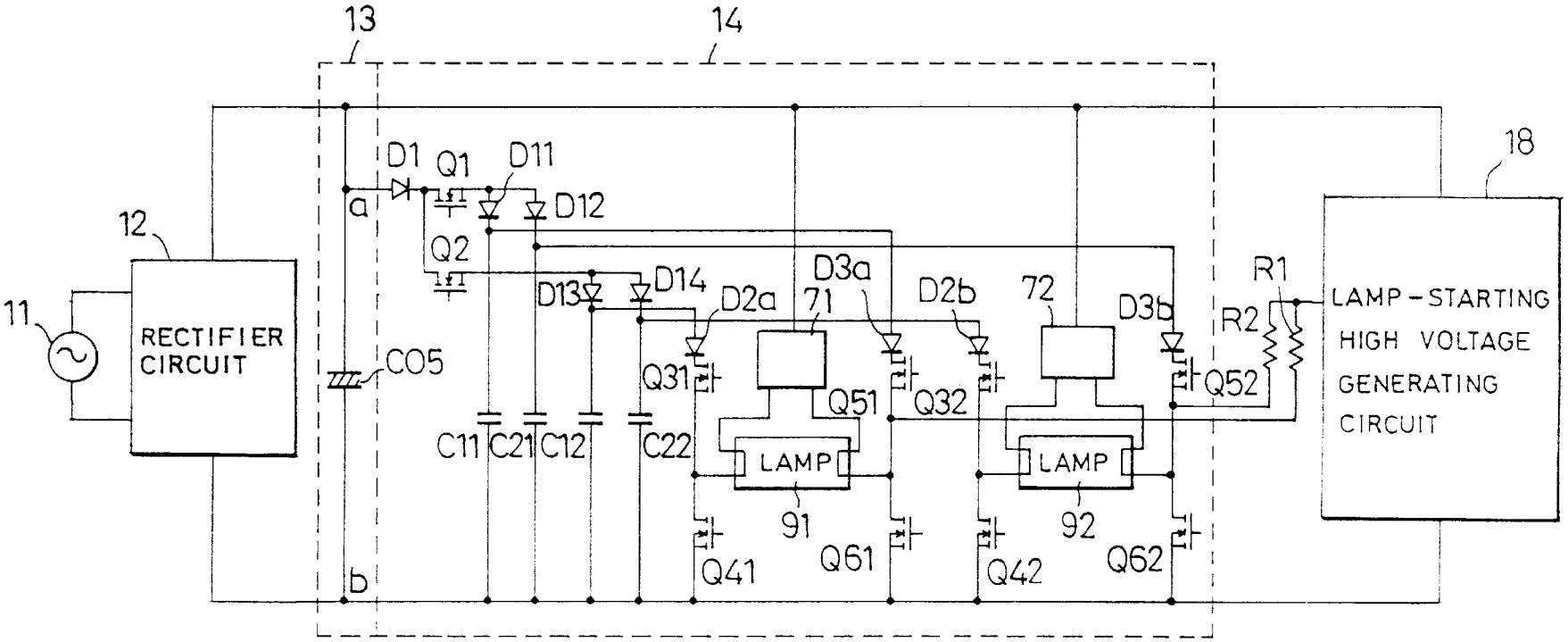
FIGS. 20 to 25 are circuit diagrams showing still other embodiments of the device according to the present invention.

The present Embodiment 6 comprises a lighting circuit 14 arranged for lighting two of preheating type discharge lamps 91 and 92 such as fluorescent lamps as shown in FIG. 20. The polarity inverting circuits and energy accumulating capacitors C11, C12, C21 and C22 are provided in correspondence to the discharge lamps 91 and 92 for charging the capacitors C11 and C21 respectively through the transistor Q1 and each of diodes D11 and D12 and the capacitors C12 and C22 respectively through the transistor Q2 and each of diodes D13 and D14. Further, to the capacitor C11, a series circuit of transistors Q51 and Q61 in the polarity inverting circuit corresponding to the discharge lamp 91 is connected in parallel through a diode D3*a* to the capacitor C12. A series circuit of transistors Q31 and Q41 is connected through a diode D2*a* in parallel to the capacitor C21. A series circuit of transistors Q52 and Q62 in the polarity inverting circuit corresponding to the discharge lamp 92 is connected through a diode D3*b* in parallel. To the capacitor 22 a series circuit of transistors Q32 and Q42 is connected through a diode D2*b* in parallel. An output end of the lamp-starting high voltage generating circuit 18 is connected through a resistor R1 to a junction point between the transistors Q51 and Q61 and through a resistor R2 to a junction point between the transistors Q52 and Q62.

That is, the present Embodiment 6 is constituted by adding the polarity inverting circuit for one discharge lamp to the lighting circuit 14 shown in FIG. 16, and by increasing the energy accumulating capacitors for supplying the energy to this polarity inverting circuit. Two preheating circuits 71 and 72 provided in correspondence to the two discharge lamps 91 and 92 are of the same arrangement as the preheating circuit 17 in FIG. 16. While the control circuit 15 is omitted from FIG. 20, an arrangement with the drive signal generating circuit added to the circuit 15 of FIG. 17 for corresponding to the transistors Q32, Q42, Q52 and Q62 of the added polarity inverting circuit can be employed.

Accordingly, in the present embodiment, the discharge lamps 91 and 92 can be lighted in parallel by charging and discharging the energy accumulating capacitors C11, C12 and C21, C22 corresponding to the respective polarity inverting circuits in the same manner as in the device of FIG. 16, and by inverting the polarity of voltage applied to the respective discharge lamps 91 and 92 by means of the polarity inverting circuits.

The arrangement in respects other than the foregoing is the same as those in FIG. 16, and detailed description of respective parts shall be omitted.

EMBODIMENT 7

Figure 21:
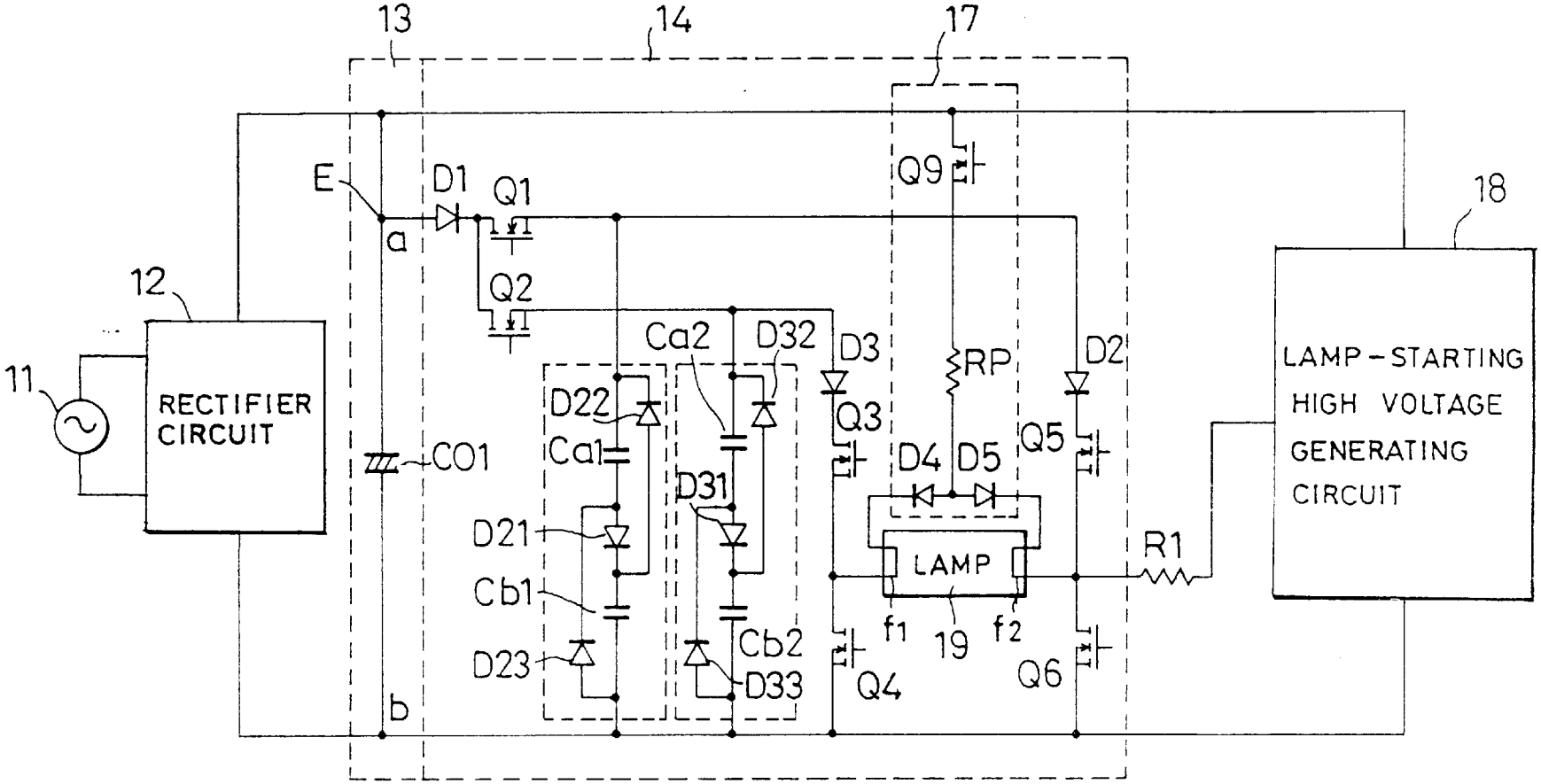

The present embodiment is constituted such that, as shown in FIG. 21, capacitors C*a*1 and C*b*1 are employed in place of the energy accumulating capacitor C1 in the circuit of FIG. 16. The capacitors C*a*1 and C*b*1 are connected in series through a diode D21 at the time of the charging. The capacitors C*a*1 and C*b*1 are connected in parallel through diodes D22 and D23 at the time of discharging. Capacitors C*a*2 and C*b*2 are employed in place of the energy accumulating capacitor C2 of FIG. 16 to be connected in series through a diode D31 when they are charging but to be connected in parallel through diodes D32 and D33 when they are discharging. The arrangement in other respects is the same as that in the embodiment of FIG. 16.

That is, when a fluorescent lamp FML 27W is to be lighted with a DC voltage of 141 to 170V obtained by rectifying and smoothing an AC source power of the source 11 of 100 to 120V, for example, the lamp voltage of this fluorescent lamp FML 27W is slightly less than about 70V at the peak value so that this lamp will be lighted at the DC voltage of 141 to 170V. There arises a risk that the lamp current will be of a waveform which is sharp in the peak value, similar to the case where the energy accumulating capacitor C1 is small as shown in FIG. 7B when adapted to a rated lamp current of 0.61A, and the life of the discharge lamp will be impaired. It is also required to employ, as the transistors Q3–Q6, one having a large current rate. In order to eliminate the risk, in the present embodiment, the energy accumulating capacitor is constituted by a plurality of capacitors in an arrangement of a ½ voltage dropping circuit.

In the present embodiment, therefore, the capacitors C*a*1 and C*b*1 are charged in a state of series connection as the transistor Q1 is turned ON, and both of their end voltages are equal to both end voltages of the smoothing circuit 13. Similarly, upon turning ON of the transistor Q2, the capacitors C*a*2 and C*b*2 are charged in a state of series connection, and both of its end voltages become equal to both end voltages E of the smoothing circuit 13. When the discharge is made with respect to the polarity inverting circuit, the capacitors C*a*1 and C*b*1 and the capacitors C*a*2 and C*b*2 are connected in parallel so that the voltage applied to the polarity inverting circuit will be ½ of both of the end voltages E of the smoothing circuit 13.

At this time, the voltage applied to the preheating type discharge lamp 19 is ½ of both end voltage E (141 to 170V) of the smoothing circuit 13, so that the discharge lamp 19 can be lighted at a voltage corresponding to the lamp voltage, and a lamp current stable in the lamp current value and flat in the waveform can be made to flow to the lamp. Thus, the present embodiment enables it possible to stabilize the lamp current without employing ballast elements such as choke coils, leakage transformers and the like. Instead the lamp current is stabilized by properly adjusting the voltage upon discharge of the energy accumulating capacitor and the lamp voltage.

In FIG. 21, the control circuit is omitted, but the same control circuit as that in FIG. 16, as shown in FIG. 17, is employed.

EMBODIMENT 8

Figure 22:
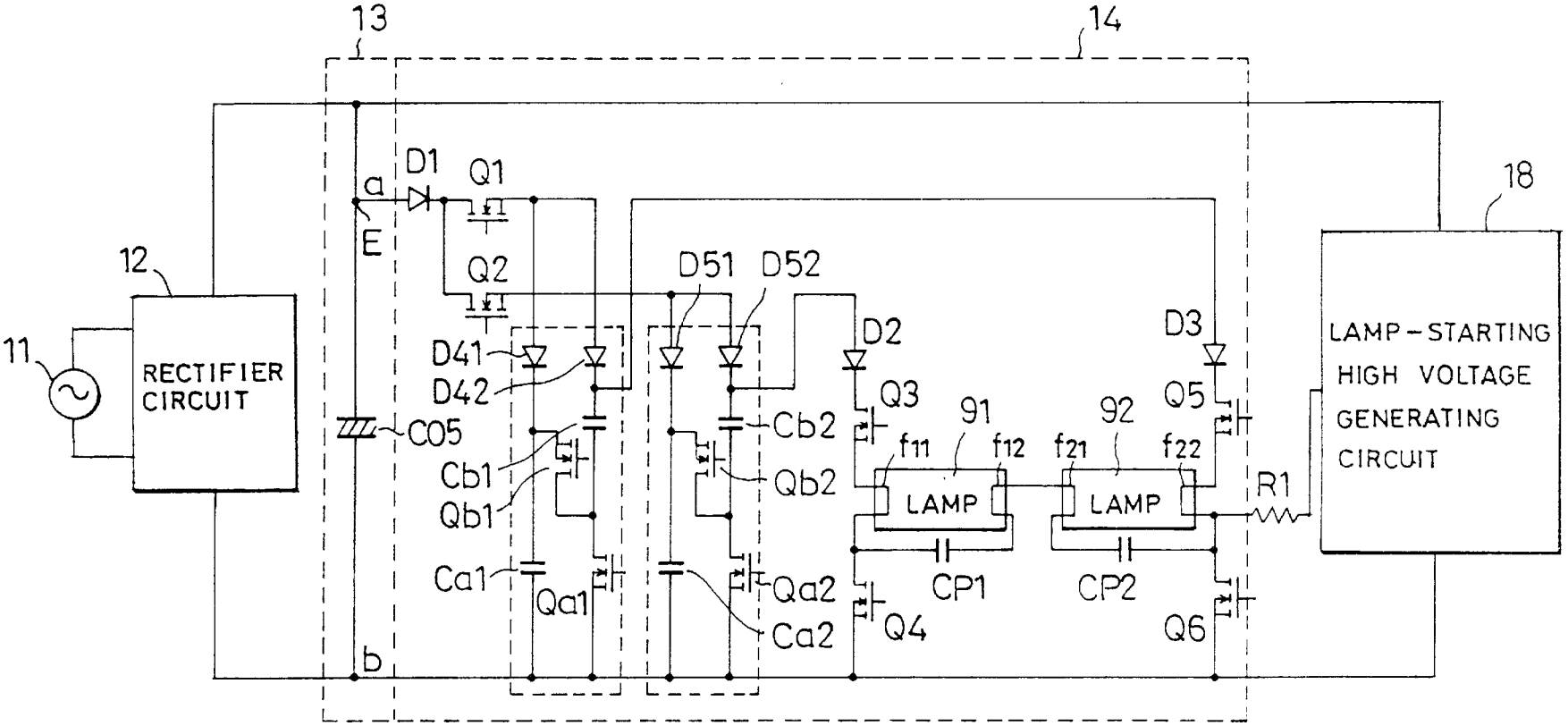

While the foregoing circuit of FIG. 20 is provided with the polarity inverting circuits corresponding to both discharge lamps 91 and 92 for their parallel lighting, the present embodiment is constituted by an AC power source of 100 to 120V with a single polarity inverting circuit employed for lighting the two preheating type discharge lamps consisting of fluorescent lamps of 40W. That is, as shown in FIG. 22, one filament f11 of one discharge lamp 91 is inserted between the transistors Q3 and Q4 forming the polarity inverting circuit of the lighting circuit 14. The other filament f22 of the other discharge lamp 92 is inserted between the transistors Q5 and Q6. The filaments f12 and f21 of both lamps 91 and 92 are mutually connected at their one end while other ends of the filaments f12 and f21 are connected respectively through each of capacitors CP1 and CP2 to one end of other filaments f11 and f22 of the lamps 91 and 92.

The energy accumulating capacitors are constituted by a plurality of capacitors in a booster circuit arrangement. The capacitors are charged in parallel relationship and are discharged in series relationship. In practice, the energy accumulating capacitors C1 and C2 in FIG. 16 are replaced by two booster circuit arrangements of capacitors, one of which arrangement comprises a capacitor C*a*1 to be charged through a diode D41 and a capacitor C*b*1 to be charged through a diode D42 and a transistor Q*a*1 as the transistors Q1 turns ON. Upon discharging, these capacitors C*a*1 and C*b*1 are connected in series through a transistor Q*b*1 for applying their charges through the diode D3 to the series circuit of the transistors Q5 and Q6. The other arrangement comprises a capacitor C*a*2 to be charged through a diode D51 and a capacitor C*b*2 to be charged through a diode D52 and a transistor Q*a*2 as the transistor Q2 turns ON. Upon discharging, these capacitors C*a*2 and C*b*2 are connected in series through a transistor Q*b*2 for applying their charges through the diode D2 to the series circuit of the transistors Q3 and Q4 in the polarity inverting circuit.

The control circuit 15, though not shown in FIG. 22, controls the respective transistors Q1 through Q6 and is employed for controlling the transistors Q*a*1 and Q*a*2 to be ON upon charging and the transistors Q*b*1 and Q*b*2 to be ON upon discharging. In the present embodiment, therefore, the transistor Q*a*1 is also ON when the transistor Q1 is ON, to charge the capacitors C*a*1 and C*b*1 in parallel relationship, upon which the both end voltages of the capacitors C*a*1 and C*b*1 will be the output voltage E of the smoothing circuit 13. Similarly, the transistors Q*a*2 and Q*b*2 are also ON when the transistor Q2 is on to charge the capacitors C*a*2 and C*b*2 in parallel relationship. In this case both end voltages of the capacitors C*a*2 and C*b*2 will be the output voltage E of the smoothing circuit 13. In performing the discharge towards the polarity inverting circuit in this way, the transistor Q*a*1 turns OFF while the transistor Q*b*1 turns ON, to have the capacitors C*a*1 and C*b*1 connected in series, for the discharge, whereupon both end voltage of the series circuit of the transistors C*a*1 and C*b*1 will be two times as high as the output voltage E of the smoothing circuit 13. Similarly, the transistor Q*b*2 is ON when the transistor Q*a*2 is OFF to connect the capacitors C*a*2 and C*b*2 in series for their discharge, upon which both end voltages of the capacitors C*a*2 and C*b*2 will be two times as high as the output voltage E of the smoothing circuit 13.

Consequently, a voltage two times as high (about 280–340V) as the output voltage (about 140–170V) of the smoothing circuit 13 is to be applied through the polarity circuit across a series circuit of the preheating type discharge lamps 91 and 92. Here, when the preheating type discharge lamps 91 and 92 are 40W fluorescent lamps, the peak value of the lamp voltage is about 130V so that, with the two lamps in series, a voltage higher than about 260V will be required. In the present embodiment, a voltage of about 280 to 340V is applied to both ends of the series circuit of the preheating type discharge lamps 91 and 92, the voltage being appropriate and never excessive, so that both discharge lamps 91 and 93 can be stably lighted.

The preheating current for the filaments f11, f12 and f21, f22 of the two discharge lamps 91 and 92 is caused to flow when the transistors Q3 and Q6 of the polarity inverting circuit are turned ON. This preheating current flows through a path of diode D2+transistor Q3+filament fit+capacitor C*p*1+filament f12+filament f21+capacitor C*p*2+transistor Q6 and, when the transistors Q4 and Q5 of the polarity inverting circuit are turned ON, through a path of diode D3+transistor Q5+filament f22+capacitor C*p*2+filament f21+filament f12+capacitor C*p*1+transistor Q4.

It should be appreciated that the lamp-starting high voltage generating circuit 18 is arranged to be substantially similar to that in Embodiment 1, but to be effective to obtain a sufficient voltage for starting the two, series connected discharge lamps 91 and 92.

EMBODIMENT 9

Figure 24:
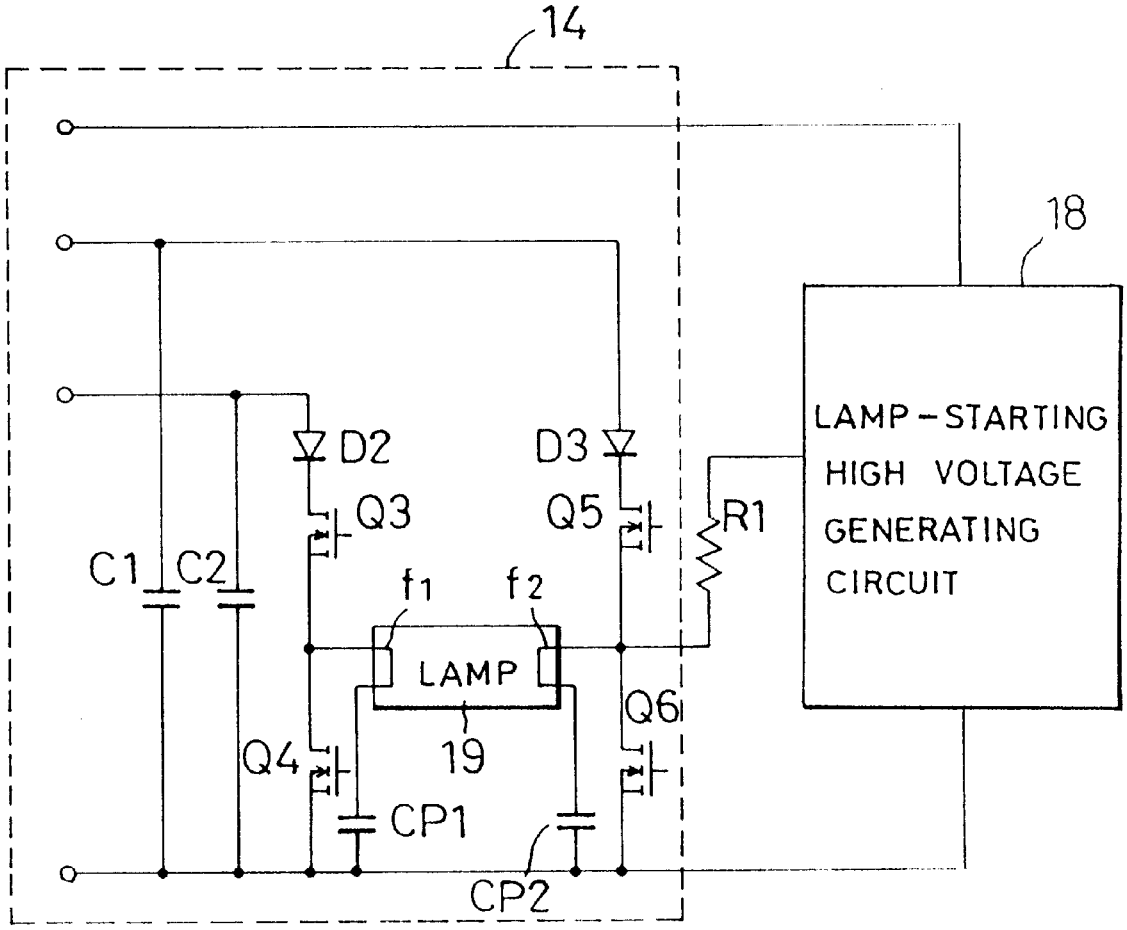

In the present embodiment, the preheating circuit 17 in the device of FIG. 16 has been modified so that the preheating circuit will be constituted as shown in FIG. 24. In the circuit of FIG. 24, with the alternate ON and OFF of the transistors Q4 and Q6 in the polarity inverting circuit utilized, a series circuit of the capacitor Cp1 and the filament f1 of the preheating type discharge lamp 19 is connected through the transistor Q4 to both output ends a and b of the smoothing circuit 13, and a series circuit of the capacitor Cp2 and the filament f2 of the lamp 19 through the transistor Q6 across both output ends a and b of the smoothing circuit 13. Thus, the preheating of the filament f1 can be constantly performed such that, when the transistor Q4 turns ON, a charge current for the capacitor Cp1 is caused to flow through a path of the output end a of the circuit 13+capacitor Cp1+filament f1+transistor Q4+output end b of the circuit 13. When the transistor Q4 turns OFF, and the transistor Q1 turns ON, the charge in the capacitor Cp1 is discharged through a path of the capacitor Cp1+output end a of the capacitor C2+diode D2+transistor Q3+filament f1+capacitor Cp1.

Further, the preheating of the filament f2 can be constantly performed such that, when the transistor Q6 turns ON, a charge current for the capacitor Cp2 is caused to flow through a path of the output end a of the smoothing circuit 13+capacitor Cp2+filament f2+transistor Q6+output end b of the circuit 13 and, when the transistor Q6 is OFF and the transistor Q2 is ON, the charge in the capacitor Cp2 is discharged through a path of the capacitor Cp2+output end a of the circuit 13+diode D1+transistor Q2+capacitor C2+capacitor C1+diode D3+transistor Q5+filament f2+capacitor Cp2.

Figure 23:
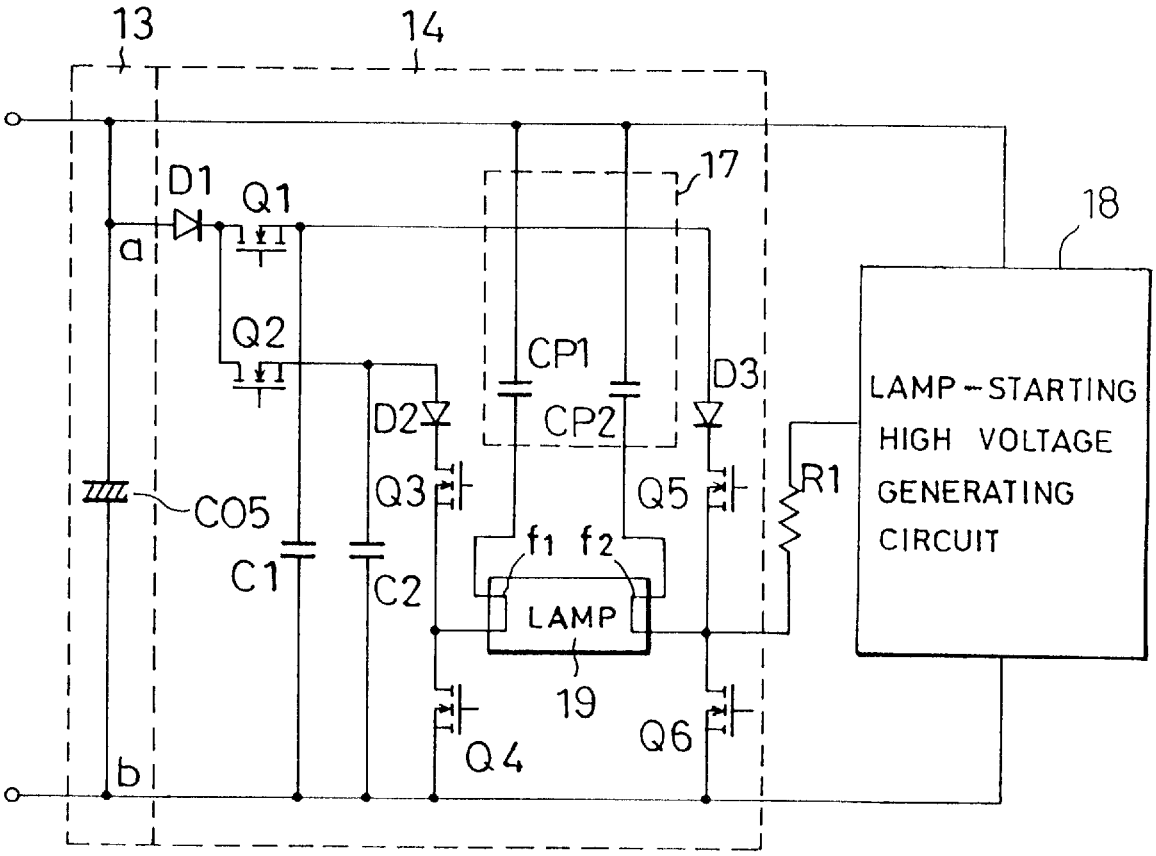

The respective preheating currents can be set to be of proper values by properly selecting the capacitance of either capacitor Cp1 or Cp2. FIG. 23 shows only constituents relative to the preheating, and all other respects of the arrangements are provided according to the device of FIG. 16.

EMBODIMENT 10

This embodiment is different from the foregoing Embodiment 9 in respect that, as shown in FIG. 24, the capacitors Cp1 and Cp2 are connected in parallel through the filaments f1 and f2 of the preheating type discharge lamp 19 to the transistors Q4 and Q6.

Thus, in the present Embodiment 10, the preheating current is made to flow to the filament f1 such that when the transistor Q3 is ON and the transistor Q4 is OFF, a charging current is caused to flow through the filament f1 to the capacitor Cp1. When the transistor Q3 is OFF, and the transistor Q4 is ON, the charge in the capacitor Cp1 is discharged through a path of the capacitor Cp1+filament f1+transistor Q4+capacitor Cp1. Similarly, the preheating current is made to flow to the filament f2 such that, when the transistor Q5 is ON, and the transistor Q6 is OFF, a charging current is caused to flow through the filament f2 to the capacitor Cp2. When the transistor Q5 is OFF and the transistor Q6 is ON, the charge in the capacitor Cp2 is discharged through a path of the capacitor Cp2+filament f2+transistor Q6+capacitor Cp2.

In the present embodiment, as in the above, the capacitors Cp1 and Cp2 are alternately made to be charged and discharged upon alternate turning ON and OFF of the transistors Q4 and Q6, to cause the preheating current to flow to the filaments f1 and f2. In FIG. 24, the constituents relating to the preheating only are shown, and the arrangement in other respects is the same as these in the device of FIG. 16.

EMBODIMENT 11

Figure 25:
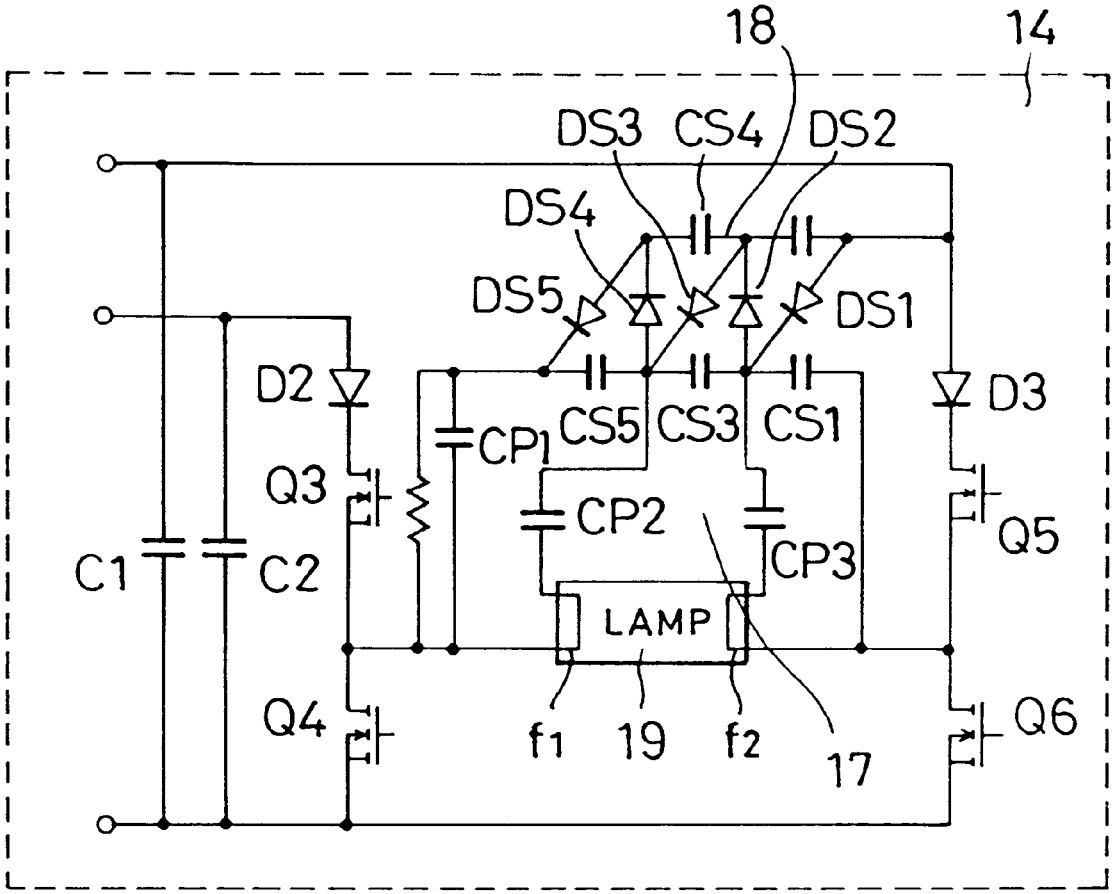

The present embodiment attempts to cause the preheating current to flow to the filaments f1 and f2 of the preheating type discharge lamp 19 by utilizing variation in both end voltage of the capacitors forming the lamp-starting high voltage generating circuit 18 in a circuit arrangement in which the transistors in the polarity inverting circuit act also as the transistors forming the lamp-starting high voltage generating circuit 18, as shown in FIG. 25. Thus, the filament of the discharge lamp 19 is connected at one end to a junction point of the transistors Q3 and Q4 of the polarity inverting circuit while the filament f2 is connected at one end to a junction point of the transistors Q5 and Q6. The capacitor Cs1 in the high voltage generating circuit 18 is connected at both ends through the capacitor Cp3 to the filament f2, and the capacitor Cs5 is connected at both ends through the capacitors Cp1 and Cp2 to the filament f1.

In this case, FIG. 25 omits the control circuit but it is possible to use substantially the same control circuit as that in FIG. 8. In the present embodiment, therefore, the preheating current is made to flow to the filament f2 by means of both end voltage of the capacitor Cs1 in the lamp-starting high voltage generating circuit 18, and the preheating current for the filament f1 is made to flow by both end voltages of the capacitor Cs5 also in the circuit 18.

It should be appreciated that, in Embodiments 9–11, the preheating of the filaments f1 and f2 of the preheating type discharge lamp 19 can be properly performed, as has been described.

In the foregoing Embodiments 1–11 the respective diodes D1–D3, D11–D14, D2*a*, D2*b*, D3*a*, D3*b*, D41, D42 and D51, D52 are reverse current preventive diodes and are not always required, in principle, for the circuit operation. However, these diodes stabilize the circuit operation in the respective embodiments and function to prevent any run-around due to parasitic diodes and any malfunction, and to reduce any power loss. Similarly, while the single diode is connected in series to the transistors Q1 and Q2, it is also possible to connect the diodes D1*a* and D1*b* mutually separately, to render the arrangement to be able to prevent run-around of the circuit current due to the parasitic diode of the transistors Q1 and Q2. Further, the device is arranged to be advantageous in that the drain-source voltage of transistors can be reduced, and the lamp-starting high voltage generating circuit 18 is connected substantially directly, only through the resistor R1 or R2, to the discharge lamp without any transistor or other like switching element, so that the required circuit parts can be reduced to render the device to be inexpensive and simplified but still useful.

While in the device of FIG. 1 or the like the single resistor RP is shown for use in preheating the lamp, it is possible to connect one resistor for every filament of the preheating type discharge lamp so as not to cause the preheating current to be unbalanced at both ends of the lamp. Further, while MOSFET or the like transistors are shown to be used as the switching element, any switching elements attaining a high speed switching operation will be employable to practice the present invention.

Further, the voltage dropping or boosting means employed as the energy accumulating capacitor may not be specifically limited to such arrangement as has been described in the embodiments.

Further, while the preheating type discharge lamp has been employed as the light source in the respective embodiments, it is possible to employ high intensity discharge lamp, cold-cathode discharge lamp or the like may be employed as the light source, and in this case the preheating circuit can be omitted. It is also possible to use the device for lighting any other light source than the discharge lamp, that is, tungsten halogen lamp, LED, flat panel display and EL lamp.

What is claimed is:

1. A discharge lamp lighting device comprising a DC power source; an energy accumulating capacitor connected in parallel to a first series circuit of said DC power source and a charging switching element; a polarity inverting circuit comprising a second series circuit of first and second switching elements connected in parallel to said energy accumulating capacitor, and a third series circuit of third and fourth switching elements connected in parallel to the capacitor, said polarity inverting circuit including a preheating type discharge lamp connected between a junction point of said first and second switching elements and a junction point of said third and fourth switching elements and applying across said discharge lamp a voltage of the capacitor with the polarity alternately inverted; a starting high voltage generating circuit for applying to the discharge lamp a light voltage for starting the discharge lamp; and a control circuit for controlling a polarity inverting frequency of the polarity inverting circuit to be above a critical fusion frequency.

2. A discharge lamp lighting device comprising a DC power source; an energy accumulating capacitor connected in parallel through a charging switching element to said DC power source: a polarity inverting circuit connected across said energy accumulating capacitor for applying across a preheating type discharge lamp a voltage of the capacitor with the polarity alternately inverted; a starting high voltage generating circuit for applying to the discharge lamp a high voltage for starting the lamp; and a control circuit for controlling a polarity inverting frequency of the polarity inverting circuit to be above a critical fusion frequency:

the polarity inverting circuit comprising a series circuit of first and second switching elements connected in parallel to said energy accumulating capacitor, a series circuit of third and fourth switching elements connected in parallel to the capacitor, the discharge lamp being connected between a junction point of said first and second switching elements and a junction point of said third and fourth switching elements;

the device further comprising a preheating circuit including a series circuit of a first diode, one of both end filaments of said preheating type discharge lamp and said second switching element, a series circuit of a second diode, the other filament of the discharge lamp and said fourth switching element, said series circuits being connected in parallel to each other, and a series circuit of a preheating switching element and a preheating current controlling element, said series circuit connecting said parallel connected series circuits to said DC power source; and said control circuit being arranged for executing said control such that, upon starting the discharge lamp, a preheating current is caused to flow to both end filaments of the discharge lamp by turning the second and fourth switching elements and said preheating switching element ON for a fixed period and applying said high voltage from the starting high voltage generating circuit across the discharge lamp after said fixed period to have the discharge lamp started, the charging switching element is turned ON during OFF period of all said first to fourth switching elements to cause the energy accumulating capacitor to be charged, and the first and fourth switching elements and the second and third switching elements are alternately turned ON and OFF during OFF period of the charging switching element, for lighting the discharge lamp with a current of said frequency above a critical fusion frequency.

3. A discharge lamp lighting device comprising a DC power source, an energy accumulating capacitor connected in parallel to a first series circuit of said DC power source and a charging switching element, a polarity inverting circuit comprising a second series circuit of first and second switching elements connected in parallel to said energy accumulating capacitor, and a third series circuit of third and fourth switching elements connected in parallel to the capacitor, said polarity inverting circuit including a preheating type discharge lamp connected between a junction point of said first and second switching elements and a junction point of said third and fourth switching elements and applying across said discharge lamp a voltage of the capacitor with the polarity alternately inverted, a starting high voltage generating circuit for applying to the discharge lamp a high voltage for starting the discharge lamp, and a control circuit for controlling a polarity inverting frequency of the polarity inverting circuit to be above a critical fusion frequency, said polarity inverting circuit being arranged for controlling ON-duty of the switching elements to stabilize a lamp current to the discharge lamp and executing a dimming control.

4. The device according to claim 1 wherein said light source comprises a plurality of discharge lamps.

5. The device according to claim 1 wherein the energy accumulating capacitor is set to provide a discharge voltage 1 to 5 times as high as a peak value of a lamp voltage of the light source.

6. The device according to claim 1 wherein the starting high voltage generating circuit comprises a Cockcroft-Walton circuit and a switching element for controlling the charging of capacitors included in said Cockcroft-Walton circuit.

7. The device according to claim 1 wherein the switching elements respectively comprise a MOSFET and a diode reverse biased with respect to a parasitic diode of the MOSFET and connected in series to the switching elements.

8. The device according to claim 1 wherein said second and third series circuits are connected in parallel to the energy accumulating capacitor, and a preheating power for causing a preheating current to flow to filaments of the discharge lamp is obtained from both end voltages of the switching elements in the polarity inverting circuit.

9. The device according to claim 1 wherein the light source is a preheating type discharge lamp, and the starting high voltage generating circuit comprises a Cockcroft-Walton circuit including a plurality of capacitors, a voltage of part of which capacitors being used to provide the preheating power for causing the preheating current to flow to filaments of the discharge lamp.

* * * * *